US006258518B1

(12) United States Patent
Taniguchi et al.

(10) Patent No.: US 6,258,518 B1
(45) Date of Patent: Jul. 10, 2001

(54) SILVER HALIDE PHOTOSENSITIVE MATERIAL

(75) Inventors: Masato Taniguchi; Hideo Ikeda, both of Minami-Ashigara (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 0 days.

(21) Appl. No.: 09/280,553

(22) Filed: Mar. 30, 1999

(30) Foreign Application Priority Data

Mar. 30, 1998 (JP) ..... 10-099946

(51) Int. Cl.[7] ..... G03C 1/34

(52) U.S. Cl. ..... 430/505; 430/503; 430/507; 430/607; 430/613

(58) Field of Search ..... 430/250, 613, 430/607, 505, 503, 507

(56) References Cited

U.S. PATENT DOCUMENTS 5,563,025 10/1996 Ishii et al. .

5,667,959 9/1997 Mikoshiba et al. .

FOREIGN PATENT DOCUMENTS

750225A1 12/1996 (EP) .

*Primary Examiner*—Thorl Chea
(74) *Attorney, Agent, or Firm*—Birch, Stewart, Kolasch & Birch, LLP

(57) ABSTRACT

A silver halide photosensitive material comprises a compound represented by formula (S1):

(Sl)

wherein $R_1$ represents a substituent group, n represents an integer from 0 to 4, $R_2$ and $R_3$ can be the same or different and represent a hydrogen atom or an alkyl group, and $R_4$ represents a hydrogen atom, an alkyl group, an aryl group, or a heterocyclic group.

20 Claims, No Drawings

SILVER HALIDE PHOTOSENSITIVE MATERIAL

BACKGROUND OF THE INVENTION

The present invention relates to a photosensitive material (to be also referred to as a "sensitive material" hereinafter) having raw stock stability and latent image stability improved by adding a specific novel organic compound without degrading the color generation properties.

Silver halide photosensitive materials are required to have high sensitivity and minimize variations in the photographic property depending on a storage period after the manufacture of the materials and before the materials are used in photographing and variations in the photographic property depending on a storage period from the time of photographing with the material to the time when the materials are developed. Note that the former property is called the raw stock stability of sensitive material and the latter property is called the latent image stability of sensitive material.

Also, full-color sensitive materials achieve full-color photographing by using a multi-layered arrangement including a plurality of emulsions different in spectral sensitivity. A full-color sensitive material is coated with a plurality of emulsions having different properties, and these emulsions are also different in raw stock stability and latent image stability. So, a technique which allows only a specific layer to achieve its effect is being strongly desired.

As a means for improving the raw stock stability and latent image stability of a photosensitive material and allowing only a specific sensitive layer to achieve its effect, a method of adding a hydroxamic acid derivative to a sensitive material is disclosed in Jpn. Pat. Appln. KOKAI Publication No. (hereafter referred to as JP-A-)8-314051 whose corresponding EP application is EP 750,225A. The present inventors evaluated the improving effect of compounds described in JP-A-8-314051 and found that the compounds were effective even under high-temperature, high-humidity conditions. However, these compounds did not show any specific improving effect under forced conditions at high oxygen partial pressure.

JP-A-9-61976, whose corresponding U.S. Patent is U.S. Pat. No. 5,667,959, has disclosed a method which reduces the residual amount of sensitizing dyes after development by adding a hydroxamic acid derivative to a sensitive material. The present inventors similarly evaluated the raw stock stability and latent image stability of compounds described in JP-A-9-61976 and found that these compounds were also not satisfactorily effective under forced conditions at high oxygen partial pressure. Additionally, it was found that the addition of these compounds to a sensitive material had an adverse effect on the color generation properties of couplers.

BRIEF SUMMARY OF THE INVENTION

Generally, it is highly unlikely that a customer intentionally stores a sensitive material in a high-oxygen partial pressure environment after purchasing it. However, sensitive materials are often kept loaded in cameras for long time periods before they are developed. The present inventors have found that oxygen adversely affects the raw stack stability and latent image stability of a sensitive material while the material is kept loaded in a camera for a long time period, and achieved the present invention. The present inventors have thought that the influence of oxygen on sensitivity materials during storage can be checked by evaluating the raw stock stability and latent image stability at high oxygen partial pressure. Note that JP-A-8-314051 and JP-A-9-61976 cited above do not describe any evaluations made by taking the influence of oxygen into consideration.

The present invention has been made in consideration of the above situation and has as its object to provide a photosensitive material which varies the photographic properties little and does not degrade the color generation properties even when stored.

DETAILED DESCRIPTION OF THE INVENTION

The above object is achieved by a silver halide photosensitive material characterized by containing a compound represented by formula (S1) below.

(S1)

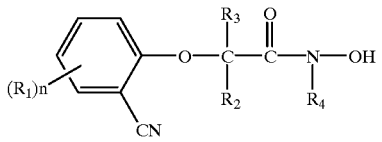

In formula (S1), $R_1$ represents a substituent group, n represents an integer from 0 to 4, $R_2$ and $R_3$ can be the same or different and represent a hydrogen atom or an alkyl group, and $R_4$ represents a hydrogen atom, an alkyl group, an aryl group, or a heterocyclic group.

Formula (S1) used in the silver halide photo-sensitive material of the present invention will be described in detail below.

In formula (S1), $R_1$ represents a halogen atom, an alkyl group, an aryl group, a heterocyclic group, a cyano group, a nitro group, a hydroxyl group, a carboxy group, a sulfo group, an alkoxy group, an aryloxy group, an acylamino group, an amino group, an alkylamino group, an anilino group, an ureido group, a sulfamoylamino group, an alkylthio group, an arylthio group, an alkoxycarbonylamino group, a sulfonamide group, a carbamoyl group, a sulfamoyl group, a sulfonyl group, an alkoxycarbonyl group, a heterocyclic oxy group, an azo group, an acyloxy group, a carbamoyloxy group, a silyl group, a silyloxy group, an aryloxycarbonylamino group, an imide group, a heterocyclic thio group, a sulfinyl group, a phosphonyl group, an aryloxycarbonyl group, and an acyl group. These substituent groups can also be substituted by an alkyl group, an alkenyl group, an alkinyl group, an aryl group, a hydroxyl group, a nitro group, a cyano group, a halogen atom, or a substituent group formed by oxygen, nitrogen, sulfur, or carbon atoms.

These examples of a substituent group represented by $R_1$ will be described in more detail below.

Examples of the halogen atom are a fluorine atom and a chlorine atom.

The alkyl group is a straight-chain, branched-chain, or cyclic alkyl group having the total number of carbon atoms of 1 to 40, preferably 1 to 22. Examples are methyl, ethyl, propyl, isopropyl, t-butyl, 2-hydroxyethyl, 3-hydroxypropyl, benzyl, 2-methanesulfonamidoethyl, 3-methanesulfonamidopropyl, 2-methanesulfonylethyl, 2-methoxyethyl, cyclopentyl, 2-acetamidoethyl, 2-carboxyethyl, 2-carbamoylethyl, 3-carbamoylpropyl, 2,3-dihydroxypropyl, 3,4-dihydroxybutyl, n-hexyl, n-octyl, n-decyl, n-dodecyl, n-tetradecyl, n-octadecyl, 1-ethylbutyl, 1-pentyloctyl, 2-hydroxypropyl, 4-hydroxybutyl, 2-carbamoylaminoethyl, 3-carbamoylaminopropyl, 4-carbamoylaminobutyl, 4-carbamoylbutyl, 2-carbamoyl-1-methylethyl, 4-nitrobutyl, and an alkyl group having the following structure.

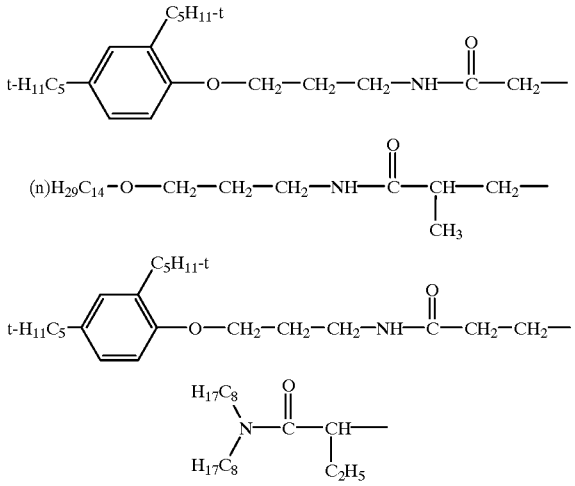

In this specification, if a substituent group represented by any of $R_1$ to $R_4$ is further substituted by another substituent group, the term "total number of carbon atoms" includes the number of carbon atoms of the latter substituent group.

The aryl group is an aryl group having the total number of carbon atoms of 6 to 24. Examples are phenyl, naphthyl, and p-methoxyphenyl.

The heterocyclic group is a 5- or 6-membered saturated or unsaturated heterocyclic ring containing one to five carbon atoms and one or more oxygen, nitrogen, or sulfur atoms as atoms constructing this heterocyclic ring. The ring can be constructed with one or a plurality of hetero atoms and the plural hetero atoms may be the same or different elements. Examples are 2-furyl, 2-thienyl, 2-pyrimidinyl, 2-benzotriazolyl, imidazolyl, and pyrazolyl.

The alkoxyl group is an alkoxy group having the total number of carbon atoms of 1 to 40, preferably 1 to 22. Examples are methoxy, ethoxy, 2-methoxyethoxy, and 2-methanesulfonylethoxy.

The aryloxy group is an aryloxy group having the total number of carbon atoms of 6 to 24. Examples are phenoxy, p-methoxyphenoxy, and m-(3-hydroxypropionamido) phenoxy.

The acylamino group is an acylamino group having the total number of carbon atoms of 1 to 40, preferably 1 to 22. Examples are acetamide, 2-methoxypropionamide, and p-nitrobenzoylamide.

The alkylamino group is an alkylamino group having the total number of carbon atoms of 1 to 40, preferably 1 to 22. Examples are dimethylamino, diethylamino, and 2-hydroxyethylamino.

The anilino group is an anilino group having the total number of carbon atoms of 6 to 24. Examples are anilino, m-nitroanilino, and N-methylanilino.

The ureido group is an ureido group having the total number of carbon atoms of 1 to 40, preferably 1 to 22. Examples are ureido, methylureido, N,N-diethylureido, 2-methanesulfonamidoethylureido.

The sulfamoylamino group is a sulfamoylamino group having the total number of carbon atoms of 0 to 40, preferably 0 to 22. Examples are dimethylsulfamoylamino, methylsulfamoylamino, and 2-methoxyethylsulfamoylamino.

The alkylthio group is an alkylthio group having the total number of carbon atoms of 1 to 40, preferably 1 to 22. Examples are methylthio, ethylthio, and 2-phenoxyethylthio.

The arylthio group is an arylthio group having the total number of carbon atoms of 6 to 24. Examples are phenylthio, 2-carboxyphenylthio, and 4-cyanophenylthio.

The alkoxycarbonylamino group is an alkoxycarbonylamino group having the total number of carbon atoms of 2 to 40, preferably 2 to 22. Examples are methoxycarbonylamino, ethoxycarbonylamino, and 3-methanesulfonylpropoxycarbonylamino.

The sulfonamide group is a sulfonamide group having the total number of carbon atoms of 1 to 40, preferably 1 to 22. Examples are methanesulfonamide, p-toluenesulfonamide, and 2-methoxyethanesulfonamide.

The carbamoyl group is a carbamoyl group having the total number of carbon atoms of 1 to 40, preferably 1 to 22. Examples are carbamoyl, N,N-dimethylcarbamoyl, and N-ethylcarbamoyl.

The sulfamoyl group is a sulfamoyl group having the total number of carbon atoms of 0 to 40, preferably 0 to 22. Examples are sulfamoyl, dimethylsulfamoyl, and ethylsulfamoyl.

The sulfonyl group is an aliphatic or aromatic sulfonyl group having the total number of carbon atoms of 1 to 40, preferably 1 to 22. Examples are methanesulfonyl, ethanesulfonyl, 2-chloroethanesulfonyl, benzenesulfonyl, and p-toluenesulfonyl.

The alkoxycarbonyl group is an alkoxycarbonyl group having the total number of carbon atoms of 1 to 40, preferably 1 to 22. Examples are methoxycarbonyl, ethoxycarbonyl, and t-butoxycarbonyl.

The heterocyclic oxy group is a 5- or 6-membered saturated or unsaturated heterocyclic oxy group containing one to five carbon atoms and one or more oxygen, nitrogen, or sulfur atoms as atoms constructing this heterocyclic ring. The ring can be constructed with one or a plurality of hetero atoms and the plural hetero atoms may be the same or different elements. Examples are 1-phenyltetrazolyl-5-oxy, 2-tetrahydropyranyloxy, and 2-pyridyloxy.

The azo group is an aromatic azo group having the total number of carbon atoms of 6 to 40, preferably 6 to 22. Examples are phenylazo, 2-hydroxy-4-propanoylphenylazo, 4-sulfophenylazo, and 4-methylimidazolylazo.

The acyloxy group is an acyloxy group having the total number of carbon atoms of 1 to 40, preferably 1 to 22. Examples are acetoxy, benzoyloxy, and 4-hydroxybutanoyloxy.

The carbamoyloxy group is a carbamoyloxy group having the total number of carbon atoms of 1 to 40, preferably 1 to 22. Examples are N,N-dimethylcarbamoyloxy, N-methylcarbamoyloxy, and N-phenylcarbamoyloxy.

The silyl group is a silyl group having the total number of carbon atoms of 3 to 40, preferably 3 to 22. Examples are trimethylsilyl, isopropyldiethylsilyl, and t-butyldimethylsilyl.

The silyloxy group is a silyloxy group having the total number of carbon atoms of 3 to 40, preferably 3 to 22. Examples are trimethylsilyloxy, triethylsilyloxy, and diisopropylethylsilyloxy.

The aryloxycarbonylamino group is an aryloxycarbonylamino group having the total number of carbon atoms of 7 to 24. Examples are phenoxycarbonylamino, 4-cyanophenoxycarbonylamino, and 2,6-dimethoxyphenoxycarbonylamino.

The imide group is an imide group having the total number of carbon atoms of 4 to 40. Examples are N-succinimide and N-phthalimide.

The heterocyclic thio group is a 5- or 6-membered saturated or unsaturated heterocyclic thio group containing one to five carbon atoms and one or more oxygen, nitrogen, or sulfur atoms as atoms constructing the heterocyclic ring. The ring can be constructed with one or a plurality of hetero atoms and the plural hetero atoms may be the same or different elements. Examples are 2-benzothiazolylthio and 2-pyridylthio.

The sulfinyl group is an aliphatic or aromatic sulfinyl group having the total number of carbon atoms of 1 to 40, preferably 1 to 22. Examples are methanesulfinyl, benzenesulfinyl, and ethanesulfinyl.

The phosphonyl group is an aliphatic or aromatic phosphonyl group having the total number of carbon atoms of 2 to 40, preferably 2 to 22. Examples are methoxyphosphonyl, ethoxyphosphonyl, and phenoxyphosphonyl.

The aryloxycarbonyl group is an aryloxycarbonyl group having the total number of carbon atoms of 7 to 24. Examples are phenoxycarbonyl, 2-methylphenoxycarbonyl, and 4-acetamidophenoxycarbonyl.

The acyl group is an acyl group having the total number of carbon atoms of 1 to 40, preferably 1 to 22. Examples are acetyl, benzoly, and 4-chlorobenzoyl.

n represents an integer from 0 to 4. When n is 0, $R_1$ is not substituted. When n is any of 1 to 4, $R_1$ can be substituted in a position where each corresponding substituent group is substitutable.

$R_2$ and $R_3$ can be the same of different and represent a hydrogen atom or an alkyl group. When $R_2$ represents an alkyl group, details of this alkyl group are the same as the alkyl group indicated by $R_1$. When $R_3$ represents an alkyl group, details of this alkyl group are the same as the alkyl group indicated by $R_1$.

$R_4$ represents a hydrogen atom, an alkyl group, an aryl group, or a heterocyclic group.

Examples of $R_4$ will be described in more detail below. When $R_4$ represents an alkyl group, details of this alkyl group are the same as the alkyl group indicated by $R_1$. When $R_4$ represents an aryl group, details of this aryl group are the same as the aryl group indicated by $R_1$. When $R_4$ represents a heterocyclic group, details of this heterocyclic group are the same as the heterocyclic group indicated by $R_1$. $R_4$ more preferably represents a straight-chain, branched-chain, or cyclic alkyl group having the total number of carbon atoms of 1 to 6. Examples of this alkyl group are methyl, ethyl, propyl, isopropyl, t-butyl, 2-hydroxyethyl, 3-hydroxypropyl, 2-methanesulfonamidoethyl, 2-methoxyethyl, cyclopentyl, 2-carboxyethyl, 2-carbamoylethyl, 3-carbamoylpropyl, 2,3-dihydroxypropyl, n-hexyl, 2-hydroxypropyl, 3-carbamoylaminopropyl, and 4-carbamoylbutyl.

Preferable combinations of $R_1$, n, $R_2$, $R_3$, and $R_4$ in formula (S1) will be described below.

$R_4$ is preferably a straight-chain alkyl group having the total number of carbon atoms of 1 to 6. As described above, this alkyl group can also be substituted by another substituent group. If this is the case, the total number of carbon atoms includes the number of carbon atoms of the latter substituent group. More preferably, $R_4$ is a straight-chain alkyl group having the total number of carbon atoms of 1 to 6, $R_2$ is an alkyl group having the total number of carbon atoms of 1 to 24, $R_3$ is a hydrogen atom, and n is 0 or 1. Most preferably, $R_4$ is a methyl group or an ethyl group, $R_2$ is an alkyl group having the total number of carbon atoms of 1 to 24, $R_3$ is a hydrogen atom, and n is 0.

Preferable practical examples of a compound represented by formula (S1) in the present invention are presented below. However, the present invention is not limited to these examples.

(S1-1)

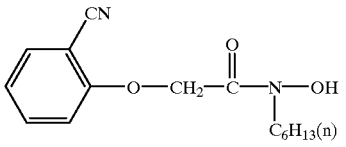

(S1-2)

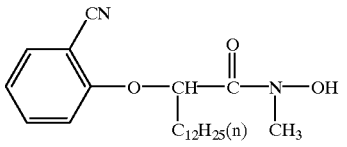

(S1-3)

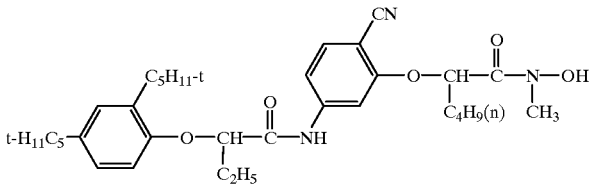

(S1-4)

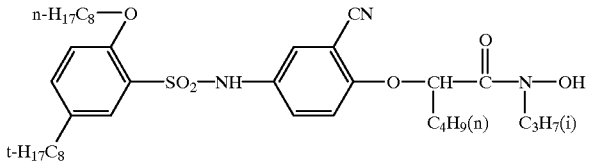

(S1-5)

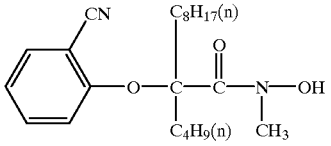

(S1-6)

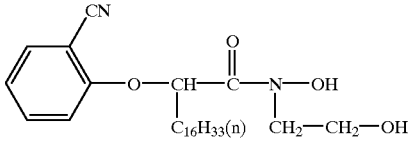

-continued
(S1-7)
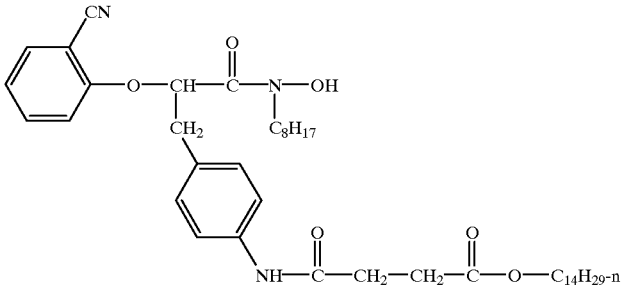
(S1-8)
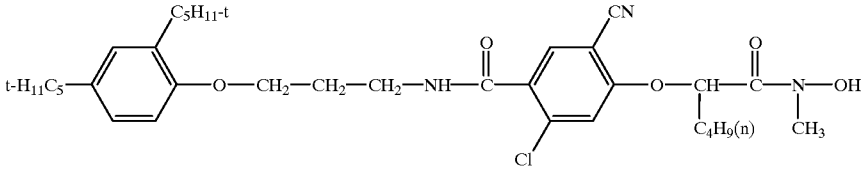
(S1-9)
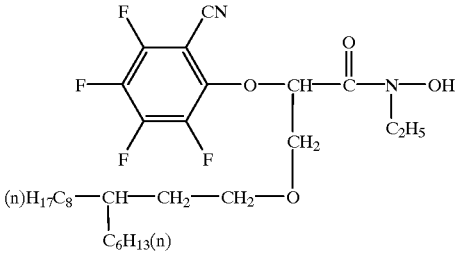
(S1-10)
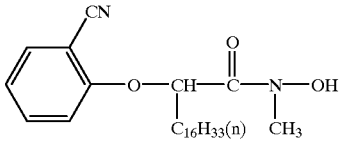
(S1-11)
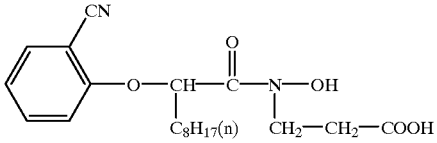
(S1-12)
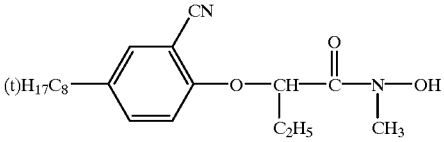
(S1-13)
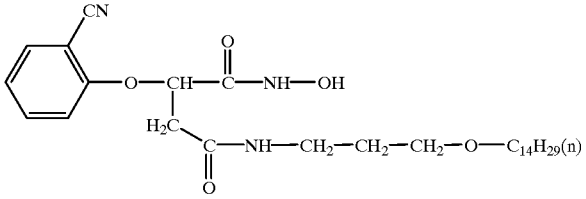
(S1-14)
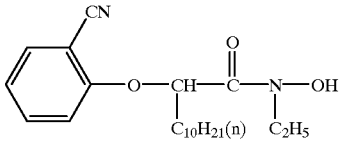
(S1-15)
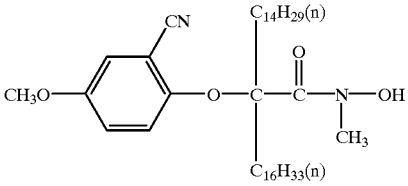
(S1-16)
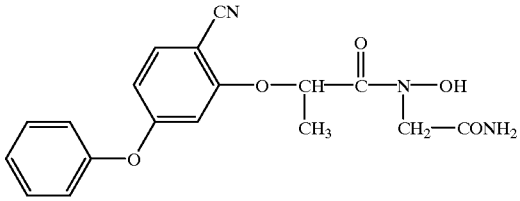

-continued (S1-17)

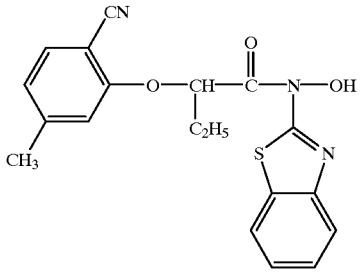

(S1-18)

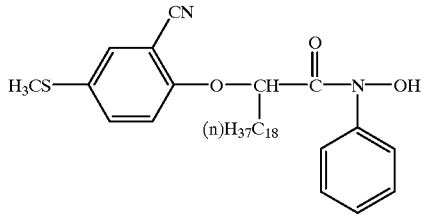

(S1-19)

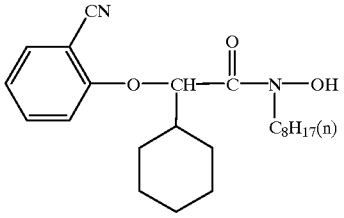

(S1-20)

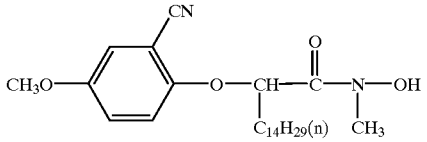

The compounds represented by formula (S1) per se can be synthesized by properly selecting methods known in organic chemistry. A representative synthesis route is indicated by scheme 1 below.

Scheme 1

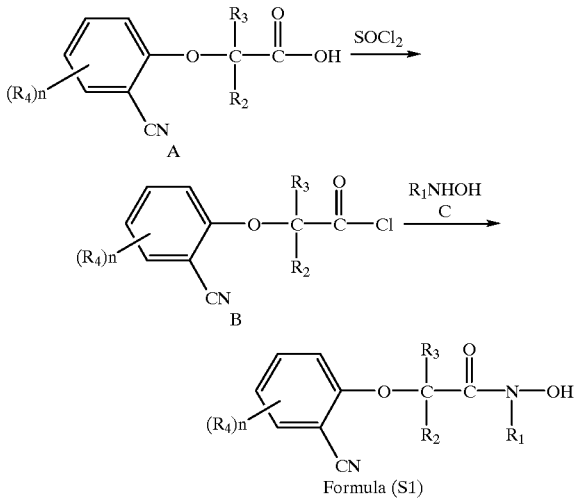

In scheme 1, $R_1$, n, $R_2$, $R_3$, and $R_4$ have the same meanings as those in formula (S1), respectively.

A compound represented by formula A in scheme 1 can be readily synthesized by reacting a phenol derivative with a corresponding α-halogenoester derivative and deriving ester to carboxylic acid by hydrolysis. The compound represented by formula B can be easily synthesized from the compound A by using thionyl chloride.

The hydroxylamine derivative represented by formula C in scheme 1 is available on the market. For example, hydrochloride corresponding to N-methylhydroxylamine is put on the market from Tokyo Kasei Kogyo K.K. Also, a method by which benzoaldoxim is N-alkylated by a halide corresponding to $R_2$ and acid-hydrolyzed and a method which reduces a nitro compound corresponding to $R_2$ by using a zinc powder are known. For example, the compound can be synthesized in accordance with Journal of Organic Chemistry, Vol. 32, p. 265 (1967) and Japan Chemical Society ed., New Experimental Science Course 14, Syntheses and Reactions of Organic Compounds (III), Maruzen, Tokyo (1977), the disclosures of which are herein incorporated by reference.

The compounds represented by formulas B and C can be reacted in the same manner as common amidation. For example, these compounds can be synthesized in accordance with Japan Chemical Society ed., New Experimental Science Course 14, Syntheses and Reactions of Organic Compounds (II), Maruzen, Tokyo (1977), the disclosures of which are herein incorporated by reference.

A practical synthesis method of compound (S1-2) set forth above and used in the present invention will be described below.

Synthesis route of compound (S1-2)

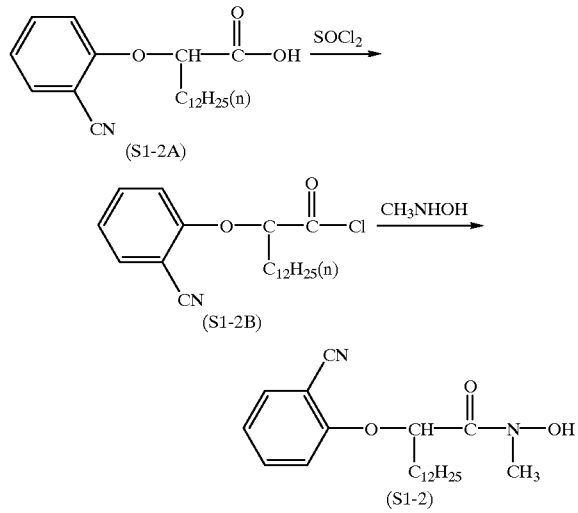

(Synthesis of Compound (S1-2B))

800 milliliters (to be represented as "mL" hereinafter) of methylene chloride were added to 800 g (2.32 mols) of a compound (S1-2A), and the resultant material was stirred at 40° C. 201 mL (2.32 mols) of thionyl chloride were dropped, and the material was stirred for 1 hr. Additionally, 100 mL (1.15 mols) of thionyl chloride were dropped, and the material was stirred for 1 hr. After that, 400 mL of the fraction were distilled off at normal pressure, and 300 mL of the fraction were distilled off at reduced pressure, thereby obtaining a compound (S1-2B).

(Synthesis of Compound (S1-2))

232 g (2.78 mols) of N-methylhydroxylamine chloride were dissolved in 2.32 liters (to be represented as "L" hereinafter) of water. 111 g (2.78 mols) of sodium hydroxide and 467 g (5.56 mols) of sodium bicarbonate were added to the resultant material, and 3.2 L of ethyl acetate were added. A solution prepared by adding 1.6 L of ethyl acetate to the entire amount of the previously synthesized compound (S1-2B) was dropped into the material under ice cooling and stirring, and the resultant material was kept stirred for 1 hr. Next, 4 L of water were added, and the deposit was filtered out. The deposit was recrystallized with 4.8 L of acetonitrile to obtain a compound (S1-2) weighing 807 g (yield from (S1-2A)=93%).

$^1$H-NMR (300 MHz, dmso-$d_6$) 0.83 (t, 3H), 1.1 to 1.6 (m, 20H), 1.8 to 2.0 (m, 2H), 3.13 (s, 1H), 5.2 to 5.3 (m, 1H), 6.85 (d, 1H), 7.07 (t, 1H), 7.58 (t, 1H), 7.70 (d, 1H), 10.24 (s, 1H). Melting point: 117 to 118° C.

The other compounds were also analogously synthesized.

The compound represented by formula (S1) can be added to any layer or layers of a silver halide photosensitive material. That is, the compound represented by formula (S1) can be added at least one layer selected from sensitive layers including a blue-sensitive layer, a green-sensitive layer, and a red-sensitive layer, and non-sensitive layers including a protective layer, an intermediate layer, a yellow filter layer, an antihalation layer, and a magenta filter layer. The compound represented by formula (S1) is added to preferably at least one sensitive layer or at least one non-sensitive layer adjacent to a sensitive layer, and more preferably at least one sensitive layer. The compound can also be added to a non-sensitive layer and diffused after coating. The compound represented by formula (S1) is particularly effective when the silver halide photosensitive material of the present invention is a color photosensitive material and the compound is added to at lease one layer containing a magenta coupler.

Although the compound represented by formula (S1) can be used singly, two or more different types of compounds can also be used together.

When a compound represented by formula (S1) is added to a sensitive layer, the addition amount thereof is $1\times10^{-4}$ to $5\times10^{-1}$ mol, preferably $1\times10^{-3}$ to $5\times10^{-1}$ mol, and more preferable $5\times10^{-3}$ to $1\times10^{-1}$ mol per mol of a silver halide contained in the sensitive layer. When the compound is added to a non-sensitive layer, the addition amount is preferably $10^{-7}$ to 1 mol, and more preferably $10^{-6}$ to $10^{-1}$ mol per mol of the total silver halide in the sensitive material. If the addition amount is smaller than above, no satisfactory effect can be obtained. On the other hand, a larger addition amount than above is unpreferable because the film thickness of sensitive material is extremely increased.

The compound represented by formula (S1) can be added either directly, after being dissolved in any of water, a water-soluble solvent such as methanol or ethanol, and a solvent mixture of these, or by emulsion dispersion. The compound can also be previously added when an emulsion is prepared. When a compound is added in the preparation of an emulsion, this compound can be added at any point during the preparation. For example, the compound can be added during silver halide grain formation, before or during desalting, before or during chemical ripening, or before the preparation of a complete emulsion. The compound can also be added separately a plurality of times during these steps. When the compound is dissolved in water, the pH is raised or lowered during the dissolution if the solubility of that compound increases when the pH is raised or lowered. The compound represented by formula (S1) is preferably added by emulsion dispersion.

An emulsion used in a silver halide photosensitive material of the present invention preferably contains tabular silver halide grains having an aspect ratio of 2 to 100. A "tabular silver halide grain" is a general term of grains having one twin plane or two or more parallel twin planes. The "twin plane" is a (111) plane on both sides of which all ions at lattice points have a mirror image relationship to each other. This tabular grain has two parallel major surfaces and side surfaces connecting these major surfaces. When a tabular grain is viewed in a direction perpendicular to its major surfaces, each major surface looks like a triangle, a hexagon, or a circular triangle or hexagon.

The aspect ratio of a tabular grain is the value obtained by dividing the grain diameter by the grain thickness. The thickness of grain can be easily measured by obliquely depositing a metal together with a latex as a reference on a grain, measuring the length of the shadow of the latex on an electron micrograph, and calculating by referring to the length of the shadow of the latex.

In the present invention, a grain diameter is the diameter (hereinafter also referred to as an "equivalent-circle diameter") of circle having the same area as the projected area of the parallel major surfaces of a grain.

The projected area of grain can be obtained by measuring the area on an electron micrograph and correcting the magnification.

The diameter of tabular grain is preferably 0.3 to 5.0 $\mu$m. The thickness of tabular grain is preferably 0.05 to 0.5 $\mu$m.

The sum of the projected areas of the tabular grains used in the present invention accounts for preferably 50% or more, and particularly preferably 80% or more of the sum of the projected areas of all silver halide grains in an emulsion. Furthermore, the aspect ratio of these tabular grains occupying this fixed area is preferably 2 to less than 100, more preferably 3 to less than 20, and most preferably 2 to less than 8.

It is sometimes possible to obtain more preferable effects by using monodispersed tabular grains. Although the structure and the method of manufacturing monodispersed tabular grains are described in, e.g., JP-A-63-151618, the disclosure of which is herein incorporated by reference, the shape of grains will be briefly described below. That is, a hexagonal tabular silver halide, in which the ratio of an edge having the maximum length with respect to the length of an edge having the minimum length is 2 or less, and which has two parallel faces as outer surfaces, accounts for 70% or more of the total projected area of all the silver halide grains in the emulsion. In addition, the grains have monodispersibility; that is, the variation coefficient of the grain size distribution of these hexagonal tabular silver halide grains (i.e., the value obtained by dividing a variation (standard deviation) in grain sizes, which are represented by equivalent-circle diameters of projected areas of the grains, by their average grain size) is 20% or less.

In the present invention, tabular grains preferably have dislocations.

Dislocations in tabular grains can be observed by a direct method performed at a low temperature using a transmission electron microscope, as described in, for example, J. F. Hamilton, Phot. Sci. Eng., 11, 57, (1967) or T. Shiozawa, J. Soc. Phot. Sci. Japan, 35, 213, (1972). That is, silver halide grains, extracted carefully from an emulsion so as not to apply a pressure at which dislocations are produced in the grains, are placed on a mesh for electron microscopic observation. Observation is performed by a transmission method while the sample is cooled to prevent damages (e.g., print out) due to electron rays. In this case, as the thickness of a grain is increased, it becomes more difficult to transmit electron rays through it. Therefore, grains can be observed more clearly by using an electron microscope of a high voltage type (200 kV or more for a grain having a thickness of 0.25 $\mu$m). From photographs of grains obtained by the above method, it is possible to obtain the positions and the number of dislocations in each grain viewed in a direction perpendicular to the major surfaces of the grain.

In tabular grains used in the present invention, dislocations are produced from a position x % of the length between the center and the edge of a tabular grain to the edge in the major axis direction of the grain. The value of x is preferably $10 \leqq x < 100$, more preferably $30 \leqq x < 98$, and most preferably $50 \leqq x < 95$. If this is the case, the shape obtained by connecting the start positions of the dislocations is almost similar to the shape of the grain. However, this shape is sometimes not perfectly similar and distorted. Dislocation lines are generally extended from the center to the edge but are sometimes zigzagged.

Grains containing ten or more dislocations account for preferably 50% (number) or more, and more preferably 80% (number) of more. Most preferably, grains containing twenty or more dislocations account for 80% (number) or more.

A method of manufacturing tabular grains used in the present invention will be described below.

Tabular grains used in the present invention can be prepared by the methods described in, e.g., Cleve, Photography Theory and Practice (1930), page 131; Gutoff, Photographic Science and Engineering, Vol. 14, pages 248 to 257, (1970); and U.S. Pat. Nos. 4,434,226, 4,414,310, 4,433,048, and 4,439,520, and British Patent No. 2,112,157, the disclosures of which are herein incorporated by reference.

In a tabular silver halide emulsion used in the present invention, any silver halide selected from silver bromide, silver iodobromide, silver iodochlorobromide, and silver chlorobromide can be used. A preferable silver halide is silver iodobromide or silver iodochlorobromide containing 30% or less of silver iodide.

The silver halide emulsion used in the present invention can have a multiple structure as the intra-grain halogen composition.

Dislocations in tabular grains used in the present invention are introduced by forming an iodide rich phase in a grain.

The iodide rich phase means a silver halide solid solution containing iodide. The silver halide in this case is preferably silver iodide, silver iodobromide, or silver chloroiodobromide, more preferably silver iodide or silver iodobromide, and most preferably silver iodide.

The amount (silver amount) of silver halide for forming this iodide rich phase is preferably 30 mol % or less, and more preferably 10 mol % or less with respect to the silver amount of whole grain.

A phase to be grown outside the iodide rich phase must have an iodide content lower than that of the iodide rich phase. This iodide content is preferably 0 to 12 mol %, more preferably 0 to 6 mol %, and most preferably 0 to 3 mol %.

A multivalent metal such as iridium, rhodium, or lead can be added during grain formation to a silver halide emulsion used in the present invention.

Also, thiocyanic acid ions can be doped during grain formation in a silver halide emulsion used in the present invention.

Chemical sensitization can be performed for a silver halide emulsion used in the present invention. This chemical sensitization can be performed by using active gelatin as described in T. H. James, The Theory of the Photographic Process, 4th ed., Macmillan, 1977, pages 67 to 76, the disclosures of which are herein incorporated by reference. The chemical sensitization can also be performed by using any of sulfur, selenium, tellurium, gold, platinum, palladium, and iridium, or by using a combination of a plurality of these sensitizers at a pAg of 5 to 10, a pH of 5 to 8, and a temperature of 30 to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent No. 1,315,755, the disclosures of which are herein incorporated by reference. The chemical sensitization is optimally performed in the presence of a gold compound and a thiocyanate compound. Alternatively, the chemical sensitization is performed in the presence of sulfur-containing compounds or hypo, thiourea-based compounds, rhodanine-based compounds, and sulfur-containing compounds described in U.S. Pat. Nos. 3,857,711, 4,266,018, and 4,054,457. The chemical sensitization can also be performed in the presence of so-called chemical sensitization aids. Examples of useful chemical sensitization aids are compounds, such as azaindene, azapyridazine, and azapyrimidine, known as compounds capable of suppressing fog and increasing sensitivity in the process of chemical sensitization. Examples of chemical sensitization aid modifiers are described in U.S. Pat. Nos. 2,131,038, 3,411,914, and 3,554,757, JP-A-58-126526, and G. F. Duffin, "Photographic Emulsion Chemistry", pages 138 to 143, the disclosures of which are herein incorporated by reference.

The surface or an arbitrary position from the surface of an emulsion used in the present invention can be chemically sensitized. However, chemical sensitization of the surface is preferred. The interior of an emulsion can be chemically sensitized in accordance with a method described in JP-A-63-264740.

Reduction sensitization will be described next.

The process of manufacturing a silver halide emulsion is roughly divided into steps of grain formation, desalting, and chemical sensitization. The grain formation step is subdivided into nucleation, ripening, and growth. These steps are not performed in a predetermined order, i.e., they are performed in a reverse order or repeatedly. Reduction sensitization can be basically performed for a silver halide emulsion in any of these steps. That is, the reduction sensitization can be performed during nucleation or physical ripening, as the initial stages of the grain formation, during growth, or prior to or after chemical sensitization. If gold sensitization is also performed, the reduction sensitization is preferably performed before this chemical sensitization so that undesired fog is not produced. Most preferably, the reduction sensitization is performed during the growth of silver halide grains. This method of performing reduction sensitization during the growth includes a method of performing reduction sensitization while silver halide grains are being physically ripened or being grown upon addition of a water-soluble silver salt and a water-soluble alkali halide, and a method of performing reduction sensitization while temporarily stopping the growth and then performing the growth again.

Methods of the reduction sensitization used in the present invention can be selected from a method of adding well-known reduction sensitizers to a silver halide emulsion, a method called silver ripening in which grains are grown or ripened in a low-pAg environment at pAg 1 to 7, and a method called high-pH ripening in which grains are grown or ripened in a high-pH environment at pH 8 to 11. Two or more of these methods can be used together.

The method of adding reduction sensitizers is preferable in that the level of reduction sensitization can be finely adjusted.

Known examples of reduction sensitizers are stannous chloride, amine and polyamic acid, a hydrazine derivative, formamidinesulfinic acid, a silane compound, and a borane compound. In the present invention, these known compounds can be selectively used. Also, two or more types of compounds can be used together. A compound used as the reduction sensitizer is preferably stannous chloride, thiourea dioxide, dimethylamineborane. Although the addition amount of the reduction sensitizers depends upon the emulsion manufacturing conditions and must be so selected, the amount is $10^{-7}$ to $10^{-3}$ mol per mol of a silver halide.

In the present invention, ascorbic acid and its derivatives can also be used as the reduction sensitizers.

Practical examples of ascorbic acid and its derivatives (to be referred to as "ascorbic acid compounds" hereinafter) are as follows.

(A-1) L-ascorbic acid (A-2) L-sodium ascorbate (A-3) L-potassium ascorbate (A-4) DL-ascorbic acid (A-5) D-sodium ascorbate (A-6) L-ascorbic acid-6-acetate (A-7) L-ascorbic acid-6-palmitate (A-8) L-ascorbic acid-6-benzoate (A-9) L-ascorbic acid-5,6-diacetate (A-10) L-ascorbic acid-5,6-o-isopropyridene The ascorbic acid compound used in the present invention is desirably used in an amount larger than the addition amount conventionally used for reduction sensitizers. For example, Jpn. Pat. Appln. KOKOKU Publication No. (hereinafter referred to as "JP-B-")57-33572 describes that "The amount of reducing agent does not usually exceed $0.75\times10^{-2}$ milli-equivalent amount ($8\times10^{-4}$ mol/AgX mol) per g of silver ion. An amount of 0.1 to 10 mg per kg of silver nitrate ($10^{-7}$ to $10^{-5}$ mol/Ag mol as an amount of ascorbic acid) is effective in many instances." (the converted values are calculated by the present inventors). U.S. Pat. No. 2,487,850 describes that "An addition amount by which a tin compound can be used as a reduction sensitizer is $1\times10^{-7}$ to $44\times10^{-6}$ mol". JP-A-57-179835 describes that a proper addition amount of thiourea dioxide is about 0.01 mg to about 2 mg per mol of a silver halide and a proper addition amount of stannous chloride is about 0.01 mg to about 3 mg. A preferable addition amount of the ascorbic acid compound used in the present invention depends upon factors such as the grain size of an emulsion, the halogen composition, and the temperature, pH, and pAg of emulsion preparation. However, the addition amount is selected from preferably $5\times10^{-5}$ to $1\times10^{-1}$ mol, more preferably $5\times10^{-4}$ to $1\times10^{-2}$ mol, and most preferably $1\times10^{-3}$ to $1\times10^{-2}$ mol per 1 mol of a silver halide.

It is possible to dissolve the reduction sensitizers in water or a solvent such as alcohols, glycols, ketones, esters, or amides, and add the resultant solution during grain formation or before or after chemical sensitization. Reduction sensitizers can be added in any process of the emulsion manufacture, but it is particularly preferable to add reduction sensitizers during grain growth. Although adding to a reactor vessel in advance is also preferred, adding at a given timing during grain formation is more preferred. It is also possible to add the reduction sensitizers to an aqueous solution of a water-soluble silver salt or a water-soluble alkali halide to form grains by using this aqueous solution. Alternatively, a method by which a solution of the reduction sensitizers is added separately several times or continuously over a long time period with the progress of grain growth is also preferred.

The silver halide photosensitive material of the present invention can be used as either a black-and-white photosensitive material including X-ray film or a color photosensitive material, and can be preferably used as a color photosensitive material.

When the sensitive material of the present invention is a color photosensitive material, this sensitive material need only have at least one blue-, green-, or red-sensitive silver halide emulsion layer on a support. The number and order of silver halide emulsion layers and non-sensitive layers are not particularly limited. A typical example is a silver halide photosensitive material having, on its support, at least one sensitive layer formed by a plurality of silver halide emulsion layers which are sensitive to essentially the same color but have different sensitivities. This sensitive layer is a unit sensitive layer which is sensitive to one of blue light, green light, and red light. In the multi-layered silver halide color photosensitive material, such unit sensitive layers are generally arranged in the order of red-, green-, and blue-sensitive layers from a support. However, according to the intended use, this order of arrangement can be reversed, or sensitive layers sensitive to the same color can sandwich another sensitive layer sensitive to a different color.

Non-sensitive layers such as interlayers can be formed between the silver halide sensitive layers and as the uppermost and lowermost layers.

This interlayer can contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers forming each unit sensitive layer, a two-layered structure of high- and low-sensitivity emulsion layers can be preferably used as described in West German Patent No. 1,121,470 or British Patent No. 923,045. In this case, layers are preferably arranged such that the sensitivity is sequentially decreased toward a support, and a non-sensitive layer can be formed between these silver halide emulsion layers. In addition, as described in JP-A-57-112751, JP-A-62-200350, JP-A-62-206541, and JP-A-62-206543, layers can be arranged such that a low-sensitivity emulsion layer is formed away from a support and a high-sensitivity layer is formed close to the support.

More specifically, layers can be arranged from the farthest side from a support in the order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL), the order of BH/BL/GL/GH/RH/RL, or the order of BH/BL/GH/GL/RL/RH.

In addition, as described in JP-B-55-34932, layers can be arranged from the farthest side from a support in the order of blue-sensitive layer/GH/RH/GL/RL. Furthermore, as described in JP-A-56-25738 and JP-A-62-63936, layers can be arranged from the farthest side from a support in the order of blue-sensitive layer/GL/RL/GH/RH.

As described in JP-B-49-15495, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities can be arranged such that the sensitivity is sequentially decreased toward the support. When a layer structure is formed by three layers having different sensitivities, these layers can be arranged in the order of medium-sensitivity emulsion layer/high-sensitivity emulsion layer/low-sensitivity emulsion layer from the farthest side from a support in a layer sensitive to one color as described in JP-A-59-202464.

In addition, the order of high-sensitivity emulsion layer/low-sensitivity emulsion layer/medium-sensitivity emulsion layer or low-sensitivity emulsion layer/medium-sensitivity emulsion layer/high-sensitivity emulsion layer can be used. Furthermore, the arrangement can be changed as described above even when four or more layers are formed.

In order to improve the color reproducibility, a donor layer (CL) with an interlayer effect, which is described in U.S. Pat. Nos. 4,663,271, 4,705,744, or 4,707,436, JP-A-62-160448, or JP-A-63-89580 and different from the main sensitive layers BL, GL, and RL in spectral sensitivity distribution, is preferably formed adjacent to or close to the main sensitive layers.

As described above, various layer types and arrangements can be selected according to the intended use of the sensitive material.

Silver halide grains except for tabular grains used in the present invention will be described below.

A preferable silver halide contained in photographic emulsion layers of a photosensitive material of the present invention is silver bromoiodide, silver iodochloride, or silver bromochloroiodide containing about 30 mol % or less of silver iodide. The most preferable silver halide is silver bromoiodide or silver bromochloroiodide containing about 0.1 mol % to about 10 mol % of silver iodide.

Silver halide grains contained in a photographic emulsion can have regular crystals such as cubic, octahedral, or tetradecahedral crystals, irregular crystals such as spherical or tabular crystals, crystals having crystal defects such as twin planes, or composite shapes thereof.

A silver halide can consist of fine grains having a grain size of about 0.2 $\mu$m or less or large grains having an equivalent-circle diameter of about 10 $\mu$m, and an emulsion can be either a polydisperse or monodisperse emulsion.

Silver halide photographic emulsions which can be used in the present invention can be prepared by methods described in, e.g., "I. Emulsion preparation and types," Research Disclosure (RD) No. 17,643 (December, 1978), pp. 22 and 23, RD No. 18,716 (November, 1979), page 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, e.g., U.S. Pat. Nos. 3,574,628 and 3,655,394 and British Patent No. 1,413,748 are also preferred.

A crystal structure can be uniform, can have different halogen compositions in the interior and the surface layer thereof, or can be a layered structure. Alternatively, a silver halide having a different composition can be bonded by an epitaxial junction or a compound except for a silver halide such as silver rhodanide or zinc oxide can be bonded. A mixture of grains having various types of crystal shapes can be used.

The above emulsion can be any of a surface latent image type emulsion which mainly forms a latent image on the surface of a grain, an internal latent image type emulsion which forms a latent image in the interior of a grain, and an emulsion of another type which has latent images on the surface and in the interior of a grain. However, the emulsion must be a negative type emulsion. The internal latent image type emulsion can be a core/shell internal latent image type emulsion described in JP-A-63-264740. A method of preparing this core/shell internal latent image type emulsion is described in JP-A-59-133542. Although the shell thickness of this emulsion depends on, e.g., development conditions, it is preferably 3 to 40 nm, and most preferably 5 to 20 nm.

A silver halide emulsion is normally subjected to physical ripening, chemical ripening, and spectral sensitization steps before it is used. Additives for use in these steps are described in Research Disclosure Nos. 17,643, 18,716, and 307,105, and relevant portions are summarized in a table to be presented later.

In a sensitive material of the present invention, it is possible to mix, in a single layer, two or more types of emulsions different in at least one characteristic of a sensitive silver halide emulsion, i.e., grain size, grain size distribution, halogen composition, grain shape, or sensitivity.

It is also possible to preferably use surface-fogged silver halide grains described in U.S. Pat. No. 4,082,553, internally fogged silver halide grains described in U.S. Pat. No. 4,626,498 and JP-A-59-214852, and colloidal silver, in sensitive silver halide emulsion layers and/or essentially non-sensitive hydrophilic colloid layers. The internally fogged or surface-fogged silver halide grain means a silver halide grain which can be developed uniformly (non-imagewise) regardless of whether the location is a non-exposed portion or an exposed portion of the sensitive material. A method of preparing the internally fogged or surface-fogged silver halide grain is described in U.S. Pat. No. 4,626,498 and JP-A-59-214852.

A silver halide which forms the core of the internally fogged core/shell type silver halide grain can have either a single halogen composition or different halogen compositions. As the internally fogged or surface-fogged silver halide, any of silver chloride, silver chlorobromide, silver bromoiodide, and silver bromochloroiodide can be used. Although the grain size of these fogged silver halide grains is not particularly limited, the average grain size is preferably 0.01 to 0.75 $\mu$m, and most preferably 0.05 to 0.6 $\mu$m. Since the grain shape is also not particularly limited, regular grains can be used. The emulsion can be a polydisperse emulsion but is preferably a monodisperse emulsion (in which at least 95% of the weight or number of grains of silver halide grains have grain sizes falling within ±40% of the average grain size).

In a method of manufacturing a photosensitive material of the present invention, photographically useful substances are commonly added to a photographic coating solution, i.e., a hydrophilic colloid solution.

A photosensitive material of the present invention is usually processed with an alkali developer containing a developing agent after imagewise exposure. After this color development, a color photosensitive material is subjected to an image formation process in which the material is processed with a processing solution containing a bleaching agent and hence having bleaching capacity.

In silver halide photographic emulsions of the present invention and silver halide photosensitive materials using the emulsions, it is generally possible to use various techniques and inorganic and organic materials described in Research Disclosure No. 308119 (1989) and No. 37038 (1995), the disclosures of which are herein incorporated by reference.

In addition, techniques and inorganic and organic materials usable in color photosensitive materials to which silver halide photographic emulsions of the present invention can be applied are described in portions of EP436,938A2 and patents cited below, the disclosures of which are herein incorporated by reference.

| | | |
|---|---|---|
| 1. | Yellow couplers | page 137, line 35 to page 146, line 33, and page 149, lines 21 to 23 |
| 2. | Magenta couplers | page 149, lines 24 to 28;, EP421,453A1, page 3, line 5 to page 25, line 55 |
| 3. | Cyan couplers | page 149, lines 29 to 33; EP432,804A2, page 3, line 28 to page 40, line 2 |
| 4. | Polymer couplers | page 149, lines 34 to 38; EP435,334A2, page 113, line 39 to page 123, line 37 |
| 5. | Colored couplers | page 53, line 42 to page 137, line 34, and page 149, lines 39 to 45 |
| 6. | Other functional couplers | page 7, line 1 to page 53, line 41, and page 149, line 46 to page 150, line 3; EP435,334A2, page 3, line 1 to page 29, line 50 |
| 7. | Antiseptic and mildewproofing agents | page 150, lines 25 to 28 |
| 8. | Formal in scavengers | page 149, lines 15 to 17 |
| 9. | Other additives | page 153, lines 38 to 47; EP421,453A1, page 75, line 21 to page 84, line 56, and page 27, line 40 to page 37, line 40 |
| 10. | Dispersion methods | page 150, lines 4 to 24 |
| 11. | Supports | page 150, lines 32 to 34 |
| 12. | Thickness and physical properties of film | page 150, lines 35 to 49 |
| 13. | Color development•black-and-white development•fogging process | page 150, line 50 to page 151, line 47; EP442,323A2, page 34, lines 11 to 54, and page 35, lines 14 to 22 |
| 14. | Desilvering process | page 151, line 48 to page 152, line 53 |
| 15. | Automatic processor | page 152, line 54 to page 153, line 2 |
| 16. | Washing•stabilizing process | page 153, lines 3 to 37 |

EXAMPLES

The present invention will be described in detail below by way of its examples, but the invention is not limited to these examples.

Example 1

(Making of Sample 101)

A multi-layered sensitive material including layers having the following compositions was formed on a 127-$\mu$m thick undercoated cellulose triacetate film support to make a sample 101. Numbers represent addition amounts per $m^2$. Note that the effects of added compounds are not restricted to the described purposes.

| | |
|---|---|
| 1st layer: Antihalation layer | |
| Black colloidal silver | silver 0.28 g |
| Gelatin | 2.20 g |
| Ultraviolet absorbent U-1 | 0.27 g |
| Ultraviolet absorbent U-3 | 0.08 g |
| Ultraviolet absorbent U-4 | 0.08 g |
| High-boiling organic solvent Oil-1 | 0.29 g |
| Dye D-3 | 10.0 mg |
| Dye D-5 | 0.12 mg |
| 2nd layer: Interlayer | |
| Gelatin | 0.38 g |
| Compound Cpd-H | 3.5 mg |
| Ultraviolet absorbent U-2 | 3.0 mg |
| High-boiling organic solvent Oil-4 | 0.06 g |
| Dye D-1 | 0.01 g |
| Dye D-2 | 0.01 g |
| Dye D-4 | 0.01 g |
| 3rd layer: Interlayer | |
| Yellow colloidal silver | silver 0.007 g |

-continued

| | |
|---|---|
| Gelatin | 0.40 g |
| Compound Cpd-J | 1.0 mg |
| 4th layer: Low-speed red-sensitive emulsion layer | |
| Emulsion A | silver 0.27 g |
| Emulsion B | silver 0.23 g |
| Emulsion C | silver 0.23 g |
| Gelatin | 0.85 g |
| Coupler C-1 | 0.04 g |
| Coupler C-2 | 0.09 g |
| High-boiling organic solvent Oil-2 | 0.09 g |
| 5th layer: Medium-speed red-sensitive emulsion layer | |
| Emulsion D | silver 0.43 g |
| Gelatin | 0.65 g |
| Coupler C-1 | 0.05 g |
| Coupler C-2 | 0.11 g |
| High-boiling organic solvent Oil-2 | 0.09 g |
| 6th layer: High-speed red-sensitive emulsion layer | |
| Emulsion E | silver 0.50 g |
| Gelatin | 1.56 g |
| Coupler C-3 | 0.63 g |
| Additive P-1 | 0.16 g |
| High-boiling organic solvent Oil-2 | 0.04 g |
| 7th layer: Interlayer | |
| Gelatin | 0.50 g |
| Compound Cpd-D | 0.02 g |
| Compound Cpd-J | 0.02 g |
| High-boiling organic solvent Oil-3 | 0.04 g |
| 8th layer: Interlayer | |
| Yellow colloidal silver | silver 0.01 g |
| Gelatin | 0.90 g |
| Compound Cpd-J | 0.07 g |
| 9th layer: Low-speed green-sensitive emulsion layer | |
| Emulsion F | silver 0.42 g |
| Emulsion G | silver 0.38 g |
| Emulsion H | silver 0.32 g |
| Surface-fogged core/shell type fine-grain silver bromide emulsion (average grain size 0.11 $\mu$m) | silver 0.08 g |
| Gelatin | 1.53 g |
| Coupler C-7 | 0.07 g |
| Coupler C-8 | 0.17 g |
| Compound Cpd-B | 0.30 mg |
| Compound Cpd-C | 2.00 mg |
| Polymer latex P-2 | 0.20 g |
| High-boiling organic solvent Oil-2 | 0.10 g |
| 10th layer: Medium-speed green-sensitive emulsion layer | |
| Emulsion I | silver 0.16 g |
| Emulsion J | silver 0.34 g |
| Gelatin | 0.57 g |
| Coupler C-4 | 0.20 g |
| Compound Cpd-B | 0.03 g |
| Polymer latex P-2 | 0.01 g |
| High-boiling organic solvent Oil-2 | 0.01 g |
| 11th layer: High-speed green-sensitive emulsion layer | |
| Emulsion K | silver 0.44 g |
| Gelatin | 0.69 g |

-continued

| | |
|---|---|
| Coupler C-4 | 0.34 g |
| Compound Cpd-B | 0.06 g |
| Polymer latex P-2 | 0.01 g |
| High-boiling organic solvent Oil-2 | 0.02 g |
| 12th layer: Yellow filter layer | |
| Yellow colloidal silver | silver 0.002 g |
| Gelatin | 0.73 g |
| Fine-crystal dispersion of dye E-1 | 0.24 g |
| Compound Cpd-J | 0.06 g |
| Polymer M-1 | 0.23 g |
| 13th layer: Low-speed blue-sensitive emulsion layer | |
| Emulsion L | silver 0.15 g |
| Emulsion M | silver 0.05 g |
| Emulsion N | silver 0.15 g |
| Gelatin | 0.55 g |
| Coupler C-5 | 0.20 g |
| Coupler C-6 | 4.00 g |
| Coupler C-9 | 0.02 g |
| 14th layer: Medium-speed blue-sensitive emulsion layer | |
| Emulsion O | silver 0.06 g |
| Emulsion P | silver 0.10 g |
| Gelatin | 0.75 g |
| Coupler C-5 | 0.35 g |
| Coupler C-6 | 5.00 g |
| Coupler C-9 | 0.30 g |
| 15th layer: High-speed blue-sensitive emulsion layer | |
| Emulsion Q | silver 0.20 g |
| Emulsion R | silver 0.02 g |
| Gelatin | 2.40 g |
| Coupler C-6 | 0.09 g |
| Coupler C-9 | 0.90 g |
| Compound Cpd-K | 0.05 mg |
| High-boiling organic solvent Oil-2 | 0.40 g |
| Additive P-2 | 0.10 g |
| 16th layer: 1st protective layer | |
| Gelatin | 1.00 g |
| Ultraviolet absorbent U-1 | 0.10 g |
| Ultraviolet absorbent U-2 | 0.03 g |
| Ultraviolet absorbent U-5 | 0.20 g |
| Compound Cpd-F | 0.40 g |
| Compound Cpd-J | 0.60 g |
| High-boiling organic solvent Oil-3 | 0.30 g |
| 17th layer: 2nd protective layer | |
| Fine-grain silver iodobromide emulsion (average grain size 0.06 μm, AgI content 1 mol %) | silver 0.10 g |
| Gelatin | 0.70 g |
| Ultraviolet absorbent U-1 | 0.06 g |
| Ultraviolet absorbent U-2 | 0.02 g |
| Ultraviolet absorbent U-5 | 0.12 g |
| High-boiling organic solvent Oil-1 | 0.07 g |
| 18th layer: 3rd protective layer | |
| Gelatin | 1.40 g |
| Polymer latex P-3 (average grain size 0.07 μm) | 0.20 g |
| Matting agent P-4 (average grain size 1.5 μm) | 5.00 g |
| Matting agent P-5 (average grain size 1.5 μm) | 0.10 g |
| Silicone oil SO-1 | 0.030 g |
| Surfactant W-2 | 0.005 g |
| Surfactant W-1 | 0.020 g |

In addition to the above compositions, additives F-1 to F-7, F-10, and F-11 were added. Also, a gelatin hardener H-1 and surfactants W-3, W-4, W-5, and W-6 for coating and emulsification were added to each layer.

Furthermore, phenol, 1,2-benzisothiazoline-3-one, 2-phenoxyethanol, phenethylalcohol, and p-hydroxybenzoic butylester were added as antiseptic and mildewproofing agents.

The sensitive emulsions used in the sample 101 are shown in Table 1 below.

TABLE 1

| Emulsion | Equivalent spherical diameter (μm) | Coefficient of deviation in distribution of equivalent circular diameter (%) | Average aspect ratio of all grains | Iodide content (mol %) | Sensitizing dye | Addition amount (× $10^{-4}$ mol/molAg) | Sensitizing dye | Addition amount (× $10^{-4}$ mol/molAg) | Sensitizing dye | Addition amount (× $10^{-4}$ mol/molAg |
|---|---|---|---|---|---|---|---|---|---|---|
| A | 0.18 | 8 | 1.0 | 3.5 | S-1 | 8.1 | S-2 | 0.3 | S-3 | 0.3 |
| B | 0.22 | 15 | 2.0 | 3.5 | S-1 | 8.9 | S-2 | 0.3 | 5-3 | 0.3 |
| C | 0.28 | 14 | 2.5 | 3.5 | S-1 | 8.8 | S-2 | 0.2 | S-3 | 0.2 |
| D | 0.35 | 10 | 3.6 | 4.8 | S-i | 7.5 | S-2 | 0.3 | S-3 | 0.2 |
| E | 0.43 | 16 | 5.0 | 1.5 | S-i | 6.7 | S-2 | 0.2 | S-3 | 0.2 |
| F | 0.15 | 7 | 1.0 | 3.5 | S-4 | 15.1 | S-5 | 1.5 | | |
| G | 0.19 | 8 | 1.0 | 3.5 | S-4 | 10.4 | S-5 | 2.0 | | |
| H | 0.29 | 11 | 2.4 | 3.5 | S-4 | 7.5 | S-5 | 1.4 | | |
| I | 0.28 | 11 | 4.5 | 3.3 | S-4 | 7.7 | S-5 | 1.4 | | |
| J | 0.40 | 16 | 4.0 | 3.3 | S-4 | 7.2 | S-5 | 1.4 | | |
| K | 0.59 | 20 | 5.9 | 2.8 | S-4 | 6.4 | S-5 | 1.2 | | |
| L | 0.24 | 9 | 1.0 | 4.6 | S-6 | 6.5 | S-7 | 2.5 | | |
| M | 0.24 | 10 | 1.0 | 4.6 | S-6 | 6.4 | S-7 | 2.4 | | |
| N | 0.31 | 13 | 3.0 | 4.6 | S-6 | 6.3 | S-7 | 2.0 | | |
| O | 0.30 | 10 | 3.0 | 4.6 | S-6 | 6.2 | 5-7 | 2.0 | | |
| P | 0.40 | 9 | 4.5 | 4.6 | S-6 | 5.6 | 5-7 | 1.8 | | |
| Q | 0.7 | 15 | 5.5 | 1.0 | S-6 | 4 | S-7 | 1.5 | | |
| R | 0.86 | 18 | 25 | 1.0 | S-6 | 3.4 | S-7 | 1.1 | | |

Note 1) All the emulsions are gold-, sulfur-, and selenium-sensitized.
Note 2) The spectral sensitizing dyes area added before chemical sensitization of all the Emulsions.
Note 3) Compounds F-8 to F-15 are properly added to optimize all the Emulsions.
Note 4) Emulsions A, B, F and G are triple structured tabular grains whose major planes are (100) planes. The other emulsions are triple structured tabular grains whose major planes are (111) planes.
Note 5) The sensitivity in internal portion of each of Emulsions A, B, E, F, I and P are higher than the sensitivity at the surface thereof.
Note 6) Epitaxial growth of silver chloride was made for each of Emulsions E, I and P, after performing chemical sensitization.
Note 7) All the Emulsions excluding Emulsions A, E and F are grains having 50 or more of dislocation lines per grain, which are observed by a transmission electron microscope.

(Preparation of Dispersion of Organic Solid Disperse Dye)

The dye E-1 was dispersed by the following method. That is, water and 70 g of W-4 were added to 1,400 g of a dye wet cake containing 30% of water, and the resultant material was stirred to form a slurry having a dye concentration of 30%. Next, Ultra Visco Mill (UVM-2) manufactured by Aimex K.K. was filled with 1,700 mL of zirconia beads with an average grain size of 0.5 mm, and the slurry was milled through UVN-2 at a peripheral speed of approximately 10 m/sec and a discharge rate of 0.5 L/min for 8 hr. The beads were filtered away, and the material was heated to 90° C. for 10 hr for a stabilization purpose. After that, water and gelatin were added to dilute the material to a dye concentration of 3%. The average grain size of the obtained fine dye grains was 0.4 μm. The grain size distribution (grain size standard deviation×100/average grain size) was 18%.

The structural formulas the like of the compounds used in this example are presented below.

C-1

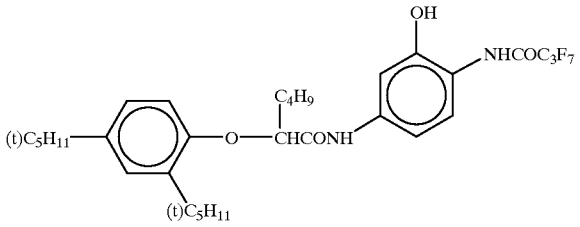

-continued

C-2

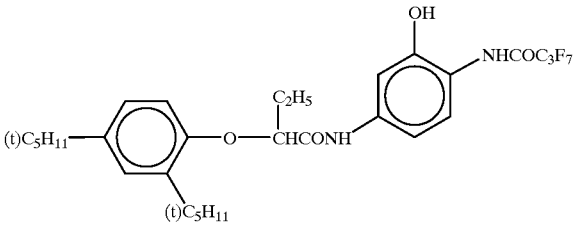

C-3

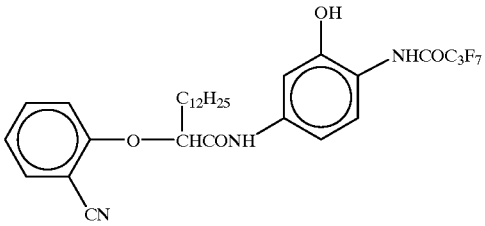

-continued
C-4
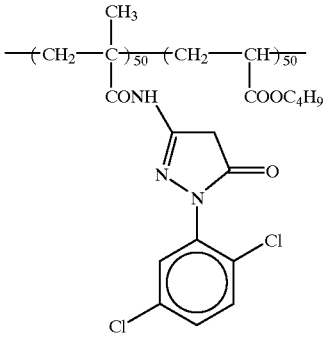
In wt.%
Av. mol. wt.: about 25,000
C-5
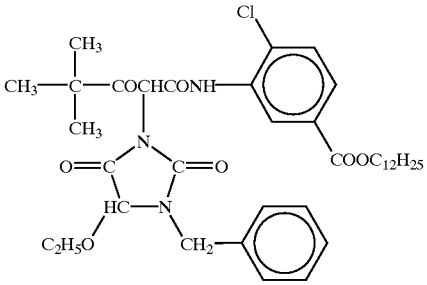
C-6
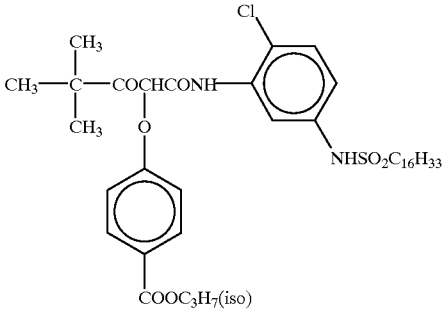
C-7
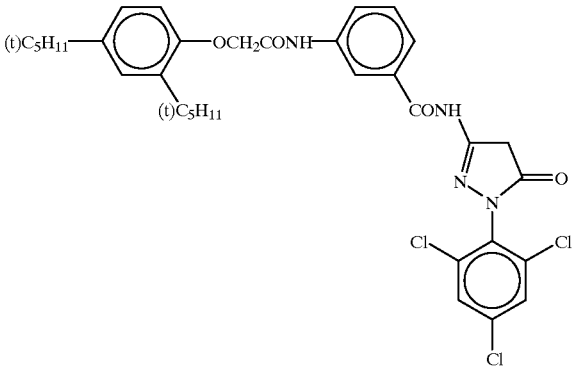
-continued
C-8
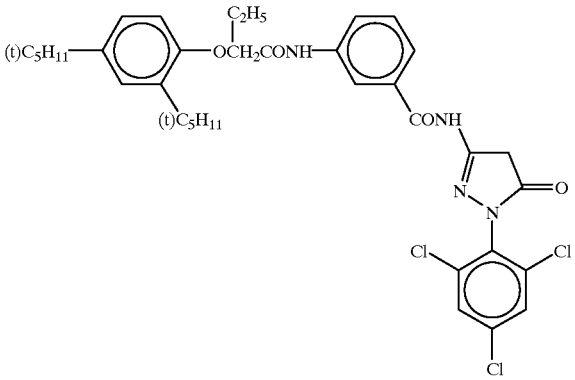
C-9
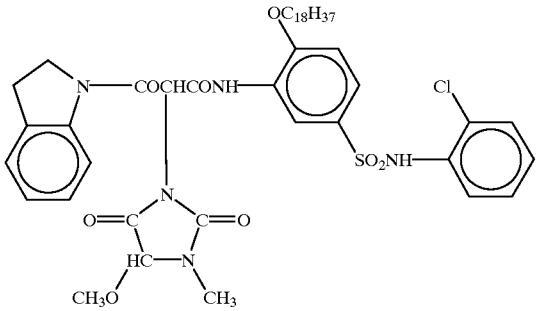
Oil-1
Dibutyl phthalate
Oil-2
Tricresyl phosphate
Oil-3
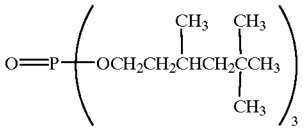
Oil-4
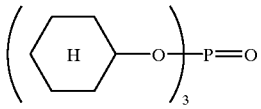
Cpd-B
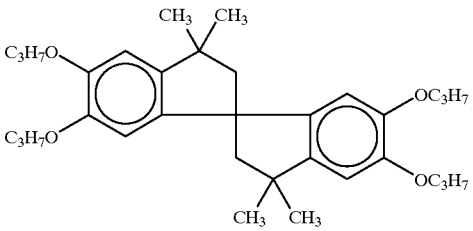

-continued
Cpd-C
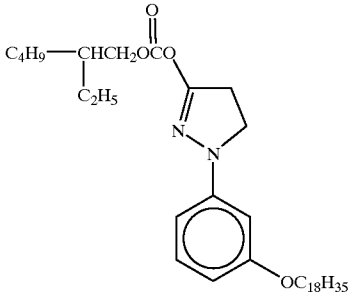
Cpd-D
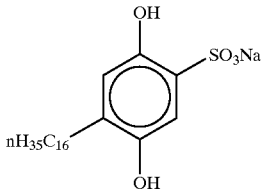
Cpd-F
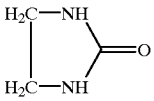
Cpd-H
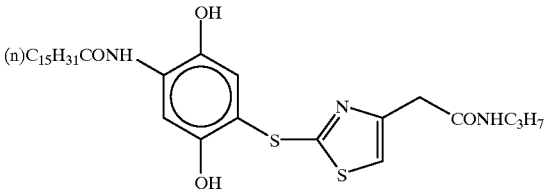
Cpd-J
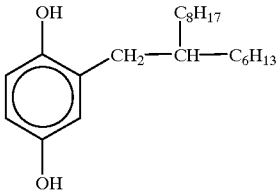
Cpd-K
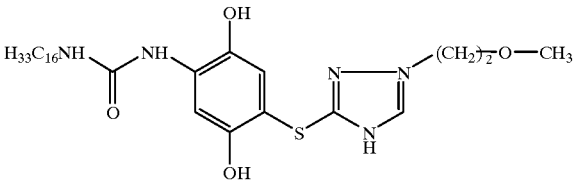
U-1
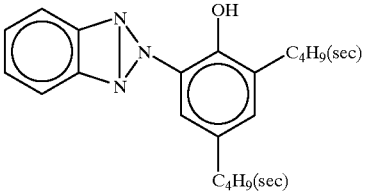
-continued
U-2
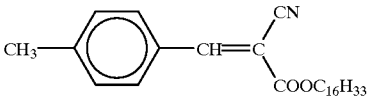
U-3
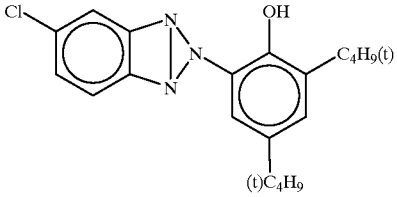
U-4
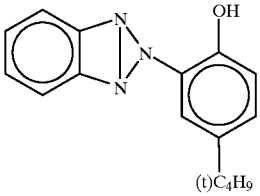
U-5
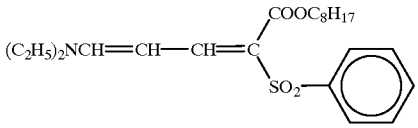
S-1
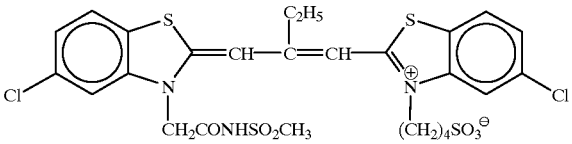
S-2
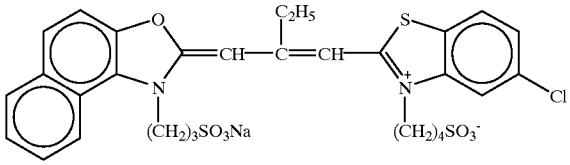
S-3
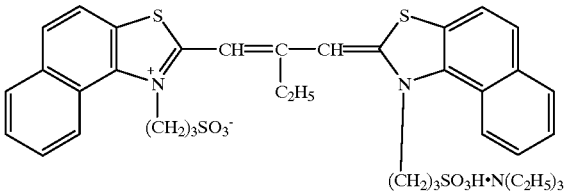
S-4
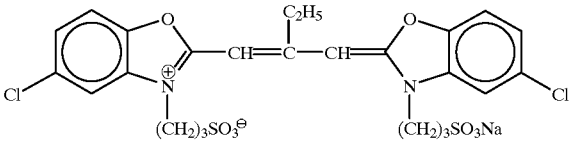

-continued
S-5
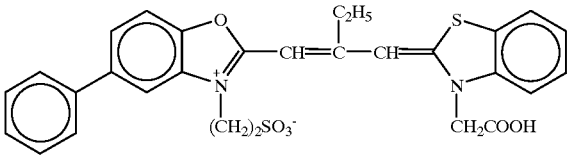
S-6
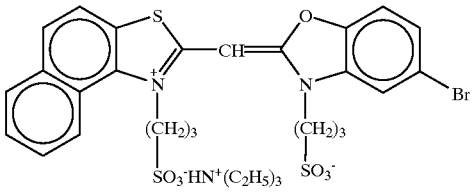
S-7
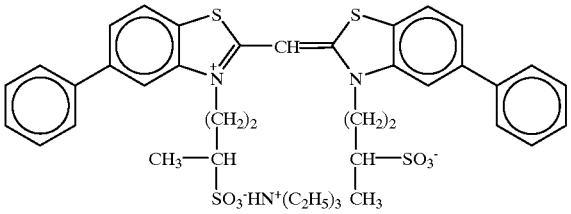
D-1
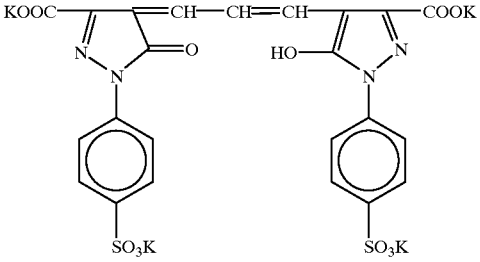
D-2
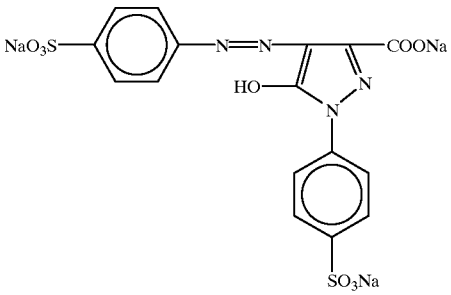
-continued
D-3
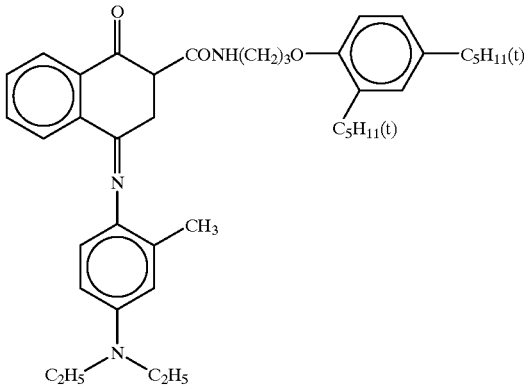
D-4
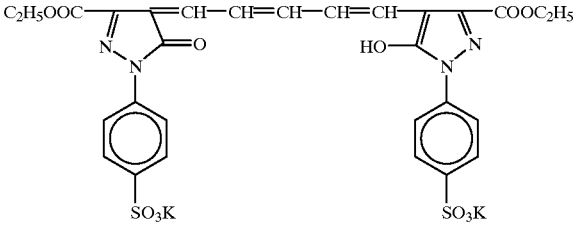
D-5
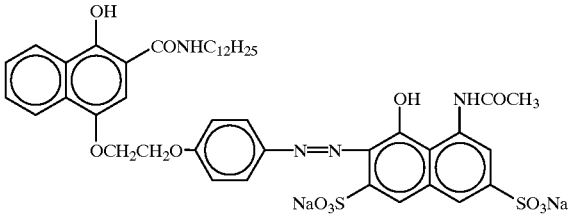
E-1
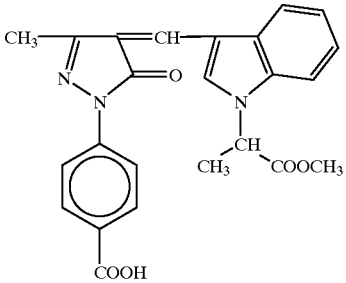
H-1
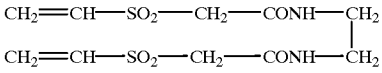
W-1
$F_{17}C_8SO_3Li$
W-2
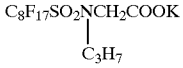
W-3
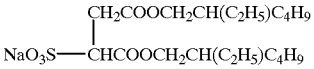

-continued
W-4
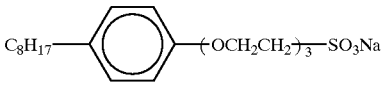
W-5
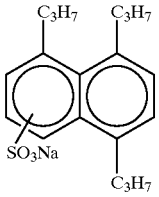
W-6
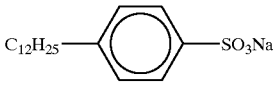
M-1
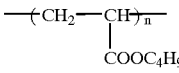
SO-1
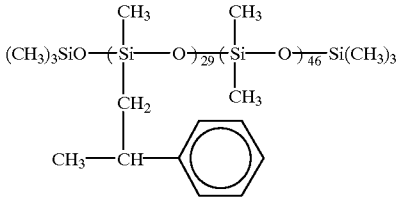
F-1
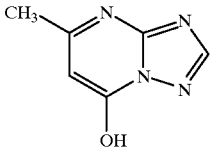
F-2
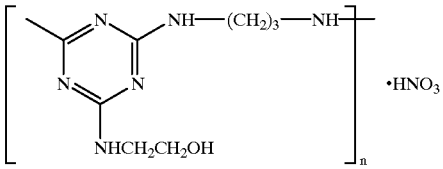
(n = 3–4)
F-3
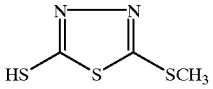
F-4
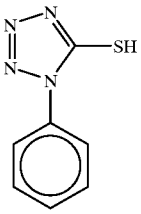
-continued
F-5
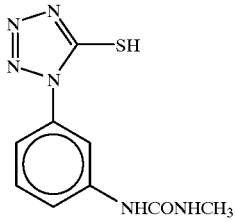
F-6
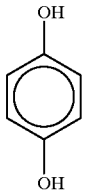
F-7
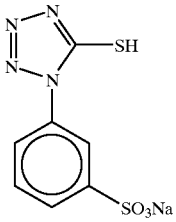
F-8
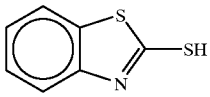
F-9
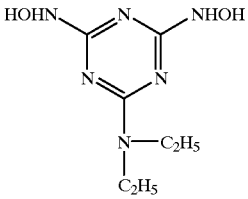
F-10
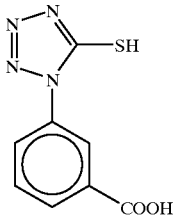
F-11
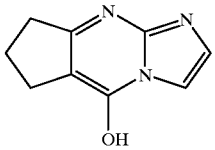
F-12
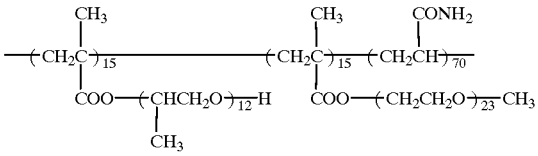

-continued

F-13

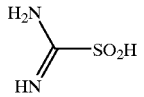

F-14

$K_2IrCl_6$

F-15

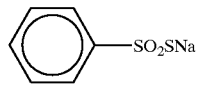

P-1

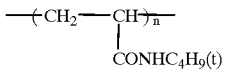

Copolymer in a ratio of 95:5 of polybutylacryrate/acrylic acid

P-2

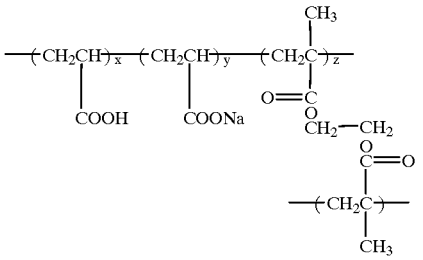

X:Y:Z = 42.5: 7.5:50

P-3

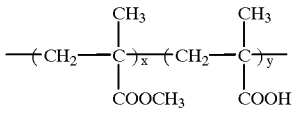

x/y = 90/10

P-4

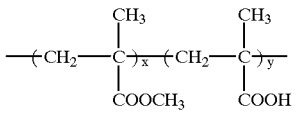

x/y = 60/40

P-5

(com-1)

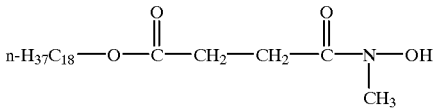

(Exemplified compound 1 described in JP-A-8-314051, whose corresponding EP application is EP 750, 225A)

(com-2)

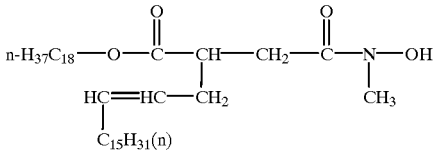

(Exemplified compound 22 described in JP-A-8-314051, whose corresponding EP application is EP 750, 225A)

-continued (com-3)

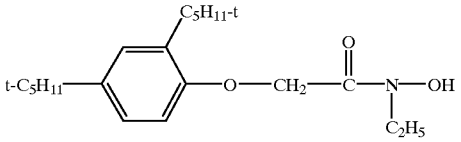

(Exemplified compound 23 described in JP-A-9-61976, whose corresponding U.S. application is U.S. 5,667,959)

(com-4)

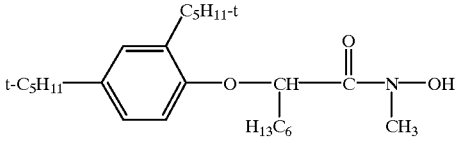

(Exemplified compound 29 described in JP-A-9-61976, whose corresponding U.S. application is U.S. 5,667,959)

Next, sample 102 was made following the same procedure as for the sample 101, except the comparative compound (com-1) set forth above was added to the 9th, 10th, 11th, 14th, and 15th layers in amounts of $5.0\times10^{-2}$, $12.5\times10^{-2}$, $8.0\times10^{-2}$, $5.0\times10^{-2}$, and $13.0\times10^{-2}$ mmol/m$^2$, respectively. Samples 103 to 112 were prepared in the same manner as for sample 102, except that comparative compounds (com-2) to (com-4) set forth above and compounds represented by formula (S1) of the invention were added instead of (com-1) as set forth in Table 2.

Changes in the photographic properties and influence on the color generation properties during storage of the sensitive materials were evaluated as follows.

(Evaluation of Raw Stock Stability)

Each obtained sample was placed in a 2-L closed vessel containing 20 mL of water, and the pressure was adjusted to $1.01\times10^5$ Pa by oxygen. The sample was aged at 60° C. for seven days, exposed, and developed through processing steps presented below. Separately, each sample was exposed and developed without being aged under the above conditions. A degree in decrement of the maximum yellow image density was measured. Table 2 shows this density decrease. The smaller the density decrease, the higher the raw stock stability.

(Evaluation of Latent Image Stability)

Each obtained sample was exposed and placed in a 2-L closed vessel containing 20 mL of water, and the pressure was adjusted to $1.01\times10^5$ Pa by oxygen. The sample was aged at 70° C. for three days and developed through processing steps presented below. Separately, each sample was developed immediately after exposed without being aged under the above conditions. A degree in decrement of the maximum yellow image density was measured. Table 2 shows this density decrease. The smaller the density decrease, the higher the latent image stability.

(Color Generation Degradation of Magenta Image)

Influence on the color generation properties of magenta image was evaluated by developing each sample immediately after it was exposed and measuring a degree in decrement of the maximum magenta image density with respect to the sample 101. Table 2 shows this density decrease. The smaller the density decrease, the smaller the influence on the color generation properties.

TABLE 2

| Sample | Compound added | Raw stock stability | Latent image stability | Decrement in color of magenta image | Remarks |
|---|---|---|---|---|---|
| 101 | None | 0.92 | 0.86 | control | Comp. |
| 102 | com-1 | 0.62 | 0.64 | 0.20 | Comp. |
| 103 | com-2 | 0.68 | 0.70 | 0.21 | Comp. |
| 104 | com-3 | 0.71 | 0.75 | 0.23 | Comp. |
| 105 | com-4 | 0.72 | 0.74 | 0.21 | Comp. |
| 106 | S1-2 | 0.19 | 0.13 | 0.01 | Inv. |
| 107 | S1-3 | 0.36 | 0.34 | 0.06 | Inv. |
| 108 | S1-8 | 0.43 | 0.47 | 0.11 | Inv. |
| 109 | S1-10 | 0.23 | 0.18 | 0.02 | Inv. |
| 110 | S1-13 | 0.48 | 0.50 | 0.14 | Inv. |
| 111 | S1-14 | 0.21 | 0.16 | 0.02 | Inv. |
| 112 | S1-20 | 0.35 | 0.38 | 0.07 | Inv. |

(Processing)

| Step | Time | Temperature | Tank volume | Quantity of replenisher |
|---|---|---|---|---|
| 1st development | 6 min. | 38° C. | 12 L | 2,200 mL/m$^2$ |
| 1st washing | 2 min. | 38° C. | 4 L | 7,500 mL/m$^2$ |
| Reversal | 2 min. | 38° C. | 4 L | 1,100 mL/m$^2$ |
| Color development | 6 min. | 38° C. | 12 L | 2,200 mL/m$^2$ |
| Pre-bleaching | 2 min. | 38° C. | 4 L | 1,100 mL/m$^2$ |
| Bleaching | 6 min. | 38° C. | 2 L | 220 mL/m$^2$ |
| Fixing | 4 min. | 38° C. | 8 L | 1,100 mL/m$^2$ |
| 2nd washing | 4 min. | 38° C. | 8 L | 7,500 mL/m$^2$ |
| Final rinsing | 1 min. | 25° C. | 2 L | 1,100 mL/m$^2$ |

The compositions of the processing solutions were as follows.

| | <Tank solution> | <Replenisher> |
|---|---|---|
| <1st developer> | | |
| Nitrilo-N,N,N-triluethylene phosphonic acid• pentasodium salt | 1.5 g | 1.5 g |
| Diethylenetriamine pentaacetic acid• pentasodium salt | 2.0 g | 2.0 g |
| Sodium sulfite | 30 g | 30 g |
| Hydroquinone•potassium monosulfonate | 20 g | 20 g |
| Potassium carbonate | 15 g | 20 g |
| Sodium bicarbonate | 12 g | 15 g |
| 1-phenyl-4-methyl-4-hydroxymethyl-3-pyrazolidone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethyleneglycol | 13 g | 15 g |
| Water to make | 1,000 mL | 1,000 mL |
| pH | 9.60 | 9.60 |
| The pH was controlled by sulfuric acid or potassium hydroxide. | | |
| <Reversal solution> | | |
| Nitrilo-N,N,N-trimethylene phosphonic acid• pentasodium salt | 3.0 g | the same as tank solution |
| Stannous chloride•dihydrate | 1.0 g | |
| p-aminophenol | 0.1 g | |
| Sodium hydroxide | 8 g | |
| Glacial acetic acid | 15 mL | |
| Water to make | 1,000 mL | |
| pH | 6.0 | |

-continued

| | <Tank solution> | <Replenisher> |
|---|---|---|
| The pH was controlled by acetic acid or sodium hydroxide | | |
| <Color developer> | | |
| Nitrilo-N,N,N-trimethylene phosphonic acid• pentasodium salt | 2.0 g | 2.0 g |
| Sodium sulfite | 7.0 g | 7.0 g |
| Trisodium phosphate• dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-N-(β-methanesulfon amidoethyl)-3-methyl-4 aminoaniline•3/2sulfuric acid•monohydrate | 11 g | 11 g |
| 3,6-dithiaoctane-1,8-diol | 1.0 g | 1.0 g |
| Water to make | 1,000 mL | 1,000 mL |
| pH | 11.80 | 12.00 |
| The pH was controlled by sulfuric acid or potassium hydroxide. | | |
| <Pre-bleaching solution> | | |
| Ethylenediaminetetraacetic acid•disodium salt• dihydrate | 8.0 g | 8.0 g |
| Sodium sulfite | 6.0 g | 8.0 g |
| 1-thioglycerol | 0.4 g | 0.4 g |
| Formaldehyde sodium bisulfite adduct | 30 g | 35 g |
| Water to make | 1,000 mL | 1,000 mL |
| pH | 6.3 | 6.10 |
| The pH was controlled by acetic acid or sodium hydroxide. | | |
| <Bleaching solution> | | |
| Ethylenediaminetetraacetic acid•disodium salt• dihydrate | 2.0 g | 4.0 g |
| Ethylenediaminetetraacetic acid•Fe(III) •ammonium• dihydrate | 120 g | 240 g |
| Potassium bromide | 100 g | 200 g |
| Ammonium nitrate | 10 g | 20 g |
| Water to make | 1,000 mL | 1,000 mL |
| pH | 5.70 | 5.50 |
| The pH was controlled by nitric acid or sodium hydroxide. | | |
| <Fixing solution> | | |
| Ammonium thiosulfate | 80 g | the same as tank solution |
| Sodium sulfite | 5.0 g | |
| Sodium bisulfite | 5.0 g | |
| Water to make | 1,000 mL | |
| pH | 6.60 | |
| The pH was controlled by acetic acid or ammonia water. | | |
| <Stabilizer> | | |
| 1,2-benzoisothiazoline-3-one | 0.02 g | 0.03 g |
| Polyoxyethylene-p-mononnyl phenylether (average polymerization degree = 10) | 0.3 g | 0.3 g |
| Polymaleic acid (average molecular weight = 2,000) | 0.1 g | 0.15 g |
| Water to make | 1,000 mL | 1,000 mL |
| pH | 7.0 | 7.0 |

As is apparent from Table 2, high raw stack stability and high latent image stability can be obtained by the addition of each compound represented by formula (S1) of the present invention. In contrast, although each comparative compound is effective, the effect is insignificant. The present inventors have noted the possibility that atmospheric oxygen may influence the raw stock stability and latent image stability of sensitive material and found the usefulness of the compounds represented by formula (S1) of the present invention by conducting the experiments of this example. JP-A-8-314051 and JP-A-9-61976 in which the comparative examples are disclosed do not describe the influence of atmospheric oxygen. Therefore, it cannot be predicted from JP-A-8-314051 and JP-A-9-61976 that such properties can be acquired by the use of the compounds represented by formula (S1) of the invention each having a chemical structure to which an aryloxy group having a cyano group in an ortho position is introduced, although this compound is also a hydroxamic acid derivative.

It is also obvious that the compounds represented by formula (S1) of the present invention has little adverse influence on the color generation properties of magenta image. Example 5 in JP-A-8-314051 describes that a decrease in the maximum color generation density is small and the latent image stability can be improved when the compounds described in JP-A-8-314051 are added to color reversal films. However, in this example the compounds are added only to blue-sensitive layers containing yellow couplers, and the example does not describe any influence when the compounds are added to green-sensitive layers containing magenta couplers. As shown in Table 2, the compounds (com-1 and com-2) in JP-A-8-314051 largely decreases the color generation properties when used together with magenta couplers. This problem cannot be solved even by a hydroxamic acid derivative having an aryloxy group described in JP-A-9-61976. By contrast, it is surprising that a decrease in the color generation properties of magenta couplers can be avoided by the use of the compounds represented by formula (S1) of the invention each having a chemical structure to which an aryloxy group having a cyano group in an ortho position is introduced, although this compound is also a hydroxamic acid derivative. It cannot be predicted that such properties can be acquired.

Example 2

(Preparation of Emulsion T1)

5.0 g of ammonium nitrate, 6.9 g of potassium bromide, and 3.5 g of low-molecular gelatin having an average molecular weight of 15,000 were added to 1 L of water. The resultant material was stirred in a vessel held at 50° C., and 40 mL (silver nitrate 4.0 g) of an aqueous silver nitrate solution and 35 mL of an aqueous solution containing 0.85 g of potassium bromide were added over 40 sec by the double-jet method.

After that, the temperature was raised to 60° C., and 40 mL of an aqueous silver nitrate solution (silver nitrate 4.0 g) were added over 10 min. Additionally, 1.0 g of potassium bromide and 18.4 g of gelatin were added.

Next, 15 mL of 1 N calcined soda were added to perform physical ripening at 60° C. for 20 min, and 4 mL of 100% acetic acid were added. Subsequently, an aqueous solution containing 162 g of silver nitrate and an aqueous solution of potassium bromide were added over 35 min by the controlled double-jet method while the pAg was held at 8.6 and the flow rates were changed. Finally, 35 mL of a potassium thiocyanate solution were added, and the temperature were lowered to 35° C. five minutes after the addition. The obtained silver halide grains were pure silver bromide tabular grains in which the sum of the projected areas of tabular grains having an aspect ratio of 3 to 30 accounted for 96% of the sum of the projected areas of all grains. The grains had an average projected area equivalent-circle diameter of 0.7 μm, an average thickness of 0.12 μm, a grain size variation coefficient of 25%, and an average aspect ratio of 6.7.

After that, the soluble salts were removed by condensation sedimentation. The temperature was again raised to 40° C., and 35 g of gelatin, 0.1 g of phenoxyethanol, and 0.4 g of sodium polystyrenesulfonate as a thickening agent were added. The pH and pAg were adjusted to 6.4 and 8.2, respectively, by calcined soda and an aqueous silver nitrate solution.

Chemical sensitization was performed while the resultant emulsion was held at 56° C. under stirring.

0.33 g of potassium iodide was added to the emulsion containing 1 mol of a silver halide. Next, 0.2 g of 4-hydroxy-6-methyl-1,3,3a,7-tetrazaindene and 3.5 mg of sodium ethylthiosulfinate were added.

Subsequently, $1\times10^{-3}$ mol of a compound A-1 and $4\times10^{-6}$ mol of a compound A-2 as a supersensitizer were added. 4.6 mg of chloroauric acid and 60 mg of potassium thiocyanate were added. $5\times10^{-6}$ mol of sodium thiosulfate and $6.5\times10^{-6}$ mol of a selenium compound A-3 were added.

$6\times10^{-4}$ mol of sodium sulfite was added when twenty minutes elapsed, and 20 mg of a compound A-4 were added when forty minutes elapsed. Lastly, the temperature was lowered to 35° C.

In this manner the preparation of a tabular grain emulsion T1 was complete.

The structural formulas of the compounds A-1 to A-9, Dye-1 to Dye-3 and Additive-1 to Additive-4, Matting agent-1 used in the Example are as follows.

Compound A-1

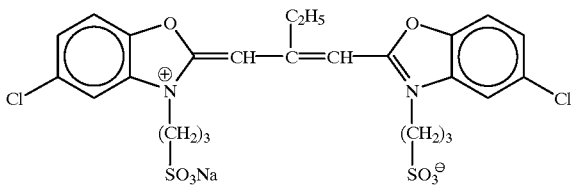

Compound A-2

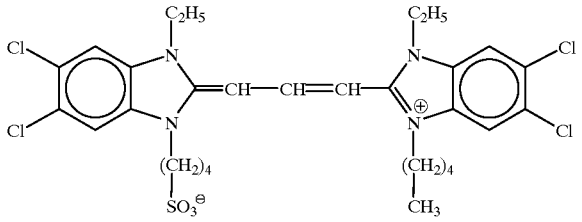

-continued
Compound A-3
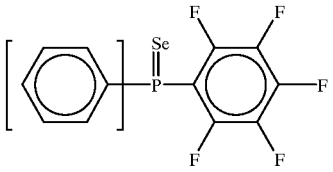
Compound A-4
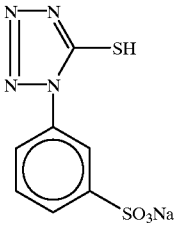
Compound A-5
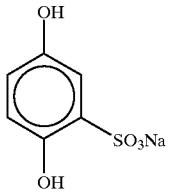
Compound A-6
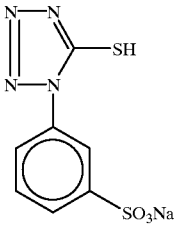
Compound A-7
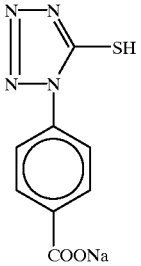
Compound A-8
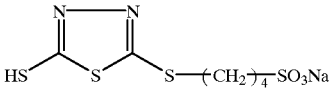
Compound A-9
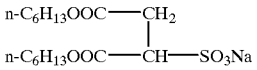
Dye-1
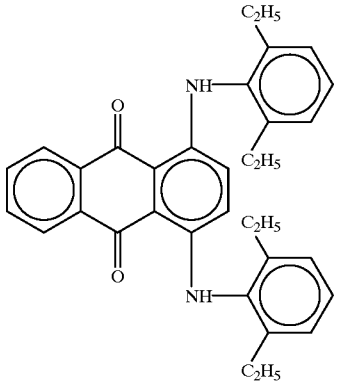
Dye-2
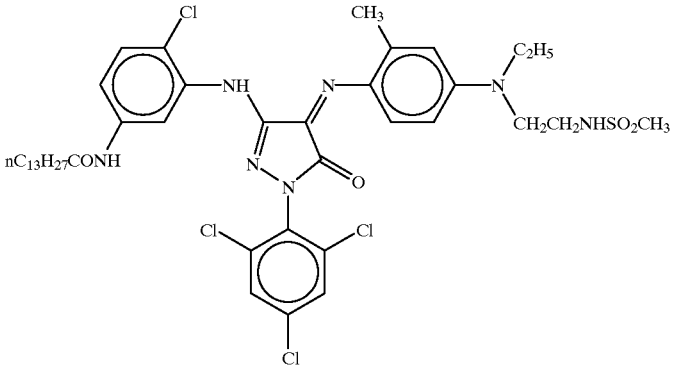

-continued

Dye-3

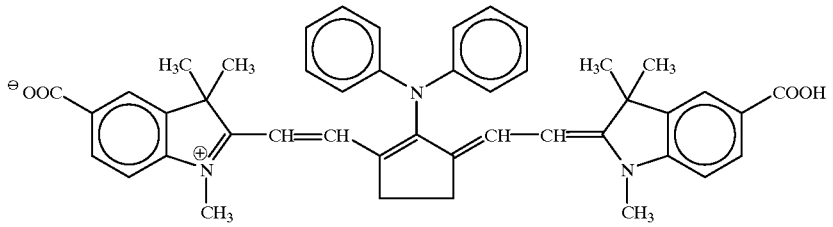

Additive-1

$C_{18}H_{33}O-(CH_2CH_2O)_{10}-H$

Additive-2

$C_8F_{17}SO_3K$

Additive-3

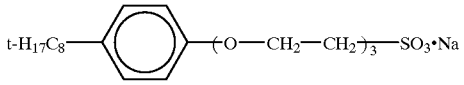

Additive-4

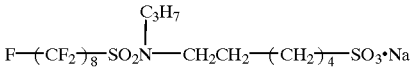

Matting agent-1

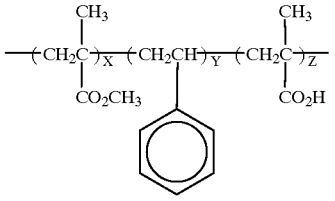

(X/Y/Z = 76.3/17.5/6.2)

(Preparation of Emulsion Layer Coating Solution)

A coating solution of an emulsion layer was prepared such that the coating amounts per side of a support of individual components added to the emulsion T1 were as follows. The coating amount of the emulsion T1 was an amount in terms of silver.

| | | |
|---|---|---|
| Emulsion T1 | silver | 1.8 mg/m$^2$ |
| 2,6-bis(hydroxyamino)-4-diethylamino-1,3,5-triazine | | 1.7 mg/m$^2$ |
| Dextran | | 0.45 g/m$^2$ |
| Sodium polystyrenesulfonate (average molecular weight 600,000) (including amount added to the emulsion) | | 33 mg/m$^2$ |
| Gelatin (including amount added to the emulsion) | | 1.1 g/m$^2$ |
| Film hardener 1,2-bis (vinylsulfonylacetamido)ethane | | 55 mg/m$^2$ |
| Compound A-5 | | 0.11 g/m$^2$ |
| Dye emulsion b (as dye solid content) | | 4.0 mg/m$^2$ |
| Dye emulsion m (as dye solid content) | | 4.0 mg/m$^2$ |

(Preparation of Dye Emulsion B)

60 g of dye-1, 62.8 g of 4-diamylphenol, 62.8 g of dicyclohexylphthalate, and 333 g of ethyl acetate were dissolved at 60° C. Next, 65 mL of an aqueous 5% solution of sodium dodecylbenzenesulfonate, 94 g of gelatin, and 581 mL of water were added. The resultant material was emulsified and dispersed at 60° C. for 30 min by a dissolver. 2 g of p-hydroxy methyl benzoate and 6 L of water were added, and the temperature was lowered to 40° C. The resultant material was then concentrated until the total amount became 2 kg by using an ultrafiltration laboratory module ACP1050 manufactured by ASAHI CHEMICAL INDUSTRY CO., LTD. Finally, 1 g of p-hydroxy methyl benzoate was added to prepare a dye emulsion b.

(Preparation of Dye Emulsion M)

10 g of Dye-2 were weighed and dissolved in a solvent composed of 10 mL of tricresylphosphate and 20 mL of ethyl acetate. The solution was emulsified and dispersed in 100 mL of an aqueous 15% gelatin solution containing 750 mg of an anionic surfactant to prepare a dye emulsion m.

(Preparation of Dye Dispersion I)

Dye-3 was handled as a wet cake such that the dye was as wet as possible. 15 g of an aqueous 5% solution of carboxymethylcellulose were added to 2.5 g of a dry solid content to obtain a total amount of 63.3 g. The resultant material was well mixed to prepare a slurry. This slurry was placed in a dispersing machine (1/16 G sand grinder mill manufactured by Aimex K.K.) containing 100 mL of glass beads having a diameter of 0.8 to 1.2 mm and dispersed for 12 hr. After that, water was added such that the dye concentration was 2 wt %, thereby preparing a dye dispersion i.

(Preparation of Surface Protective Layer Coating Solution)

A coating solution of a surface protective layer was prepared such that the coating amounts of individual components of the surface protective layer were as follows.

| | |
|---|---|
| Gelatin | 0.60 g/m$^2$ |
| Benzoisothiazolone | 1.4 mg/m2 |
| Sodium polyacrylate (average molecular weight 41,000) | 17 mg/m$^2$ |
| Additive-1 | 35 mg/m$^2$ |
| Additive-2 | 5.4 mg/m$^2$ |
| Additive-3 | 22.5 mg/m$^2$ |
| Additive-4 | 0.5 mg/m$^2$ |
| Matting agent-1 (average grain size 3.7 $\mu$m) | 72.5 mg/m$^2$ |

(Preparation of Intermediate Layer Coating Solution)

| | |
|---|---|
| Gelatin | 0.50 g/m$^2$ |
| Benzoisothiazolone | 1.4 mg/m$^2$ |

-continued

| | |
|---|---|
| Sodium polyacrylate (average molecular weight 41,000) | 17 mg/m$^2$ |
| Compound A-6 | 4.4 mg/m$^2$ |
| Compound A-7 | 1.3 mg/m$^2$ |
| Compound A-8 | 0.5 mg/m$^2$ |
| Dye dispersion i (as dye solid content) | 18 mg/m$^2$ |

(2) Preparation of Support

Corona discharge was performed on one surface of a 175-$\mu$m thick biaxially oriented polyethyleneterephthalate film, and the surface was coated with 4.9 mL/m$^2$ of a first undercoating solution having the following composition by a wire bar coater. The resultant film was dried at 185° C. for 1 min.

Next, another first undercoating layer was formed on the opposite surface following the same procedure as above. The polyethyleneterephthalate used contained 0.04 wt % of the dye-1.

Butadiene/styrene copolymer latex solution (solid content 40%, butadiene/styrene weight ratio=31/69) 158 mL.2,4-dichloro-6-hydroxy-s-triazine

| | |
|---|---|
| sodium salt 4% solution | 41 mL |
| Distilled water | 801 mL |

*Latex solution contained 0.4 wt % of a compound A-9 as an emulsion dispersant with respect to a latex solid content.

(Preparation of Development Replenisher)

A development replenisher A having the following composition and containing sodium erysorbinate as a developing agent was prepared.

| | |
|---|---|
| Diethylenetriamine pentaacetic acid | 8.0 g |
| Sodium sulfite | 19.6 g |
| Sodium bisulfite | 2.8 g |
| Sodium carbonate.monohydrate | 52.0 g |
| Potassium carbonate | 55.0 g |
| Sodium erysorbinate | 60.0 g |
| 4-hydroxymethyl-4-methyl-1-phenyl-3-pyrazolidone | 13.2 g |
| 3,3'-diphenyl-3,3'-dithiopropionic acid | 1.44 g |
| Diethyleneglycol | 50.0 g |
| Water to make | 1 L |

The pH was adjusted to 10.1 by sodium hydroxide or acetic acid.

(Preparation of Development Mother Solution)

2 L of the development replenisher A were diluted to 4 L by water. 55 mL of a starter solution having the following composition were added per L of the development replenisher A. The pH was adjusted to 9.5 to prepare a development mother solution.

| | | |
|---|---|---|
| Starter solution | potassium bromide | 11.1 g |
| | acetic acid | 10.8 g |
| | water to make | 55 mL |

(Preparation of Fixing Replenisher)

A fixing replenisher having the following composition was prepared.

| | |
|---|---|
| Water | 0.5 L |
| Ethylenediaminetetraacetic acid. dihydrate | 0.05 g |
| Sodium thiosulfate.pentahydrate | 300 g |
| Sodium bisulfite | 98.0 g |
| Sodium hydroxide | 2.91 g |

The pH was adjusted to 5.4 by NaOH, and water was added to make 1 L.

(Preparation of Fixing Mother Solution)

2 L of the fixing replenisher were diluted to 4 L by water. The pH was 5.6.

(Photographic Material Processing Method)

In an automatic processor FPM-1300 manufactured by Fuji Photo Film Co., Ltd., having an improved aperture of 0.02, processing was performed by using the developer and fixing solution described above while the development replenisher and the fixing replenisher were mixed with water at a ratio of 1:1 immediately before replenished in an amount of 103 mL per m$^2$ of a photo-sensitive material. Individual steps were as follows when the processing was performed dry-to-dry for 120 sec.

| Step | Temperature | Time |
|---|---|---|
| Development | 35° C. | 25 sec |
| Fixing | 35° C. | 25 sec |
| Washing | 25° C. | 30 sec |
| Drying | 55° C. | 40 sec |
| Total (dry to dry) | | 120 sec |

(Preparation of Sample 201)

The two surfaces of the aforementioned support were coated with the previously prepared emulsions and surface projective layer and intermediate layer coating solutions by the co-extrusion technique. Note that the chemical amounts in each emulsion were changed for each coating solution such that the coating gelatin amounts and chemical amounts in emulsion layers were constant.

(Preparation of Samples 202–207)

Samples 202 to 207 were made by preparing emulsion layer coating solutions following the same procedures as for the sample 201, except that a compound represented by formula (S1) of the present invention was added in a coating amount of $1.6\times10^{-2}$ mmol/m$^2$ per side of a support to the emulsion coating solutions of the sample 201.

(Evaluation of Raw Stock Stability)

Each obtained sample was placed in a closed vessel, and the pressure was adjusted to $1.01\times10^5$ Pa by oxygen. After the sample was aged at 70° C. for 14 days, the two sides of the sample were exposed for 0.1 sec by using an X-ray ortho screen HG-M manufactured by Fuji Photo Film Co., Ltd., and the sample was developed in accordance with the processing method described earlier. Separately, each sample was exposed and developed without being aged under the above conditions. The fog densities of these two types of samples were compared. Table 3 shows the fog density increase. The smaller the value, the higher the raw stock stability.

TABLE 3

| Sample | Compound added | Raw stock stability | Remarks |
|---|---|---|---|
| 201 | None | 0.81 | Comp. |
| 202 | S1-2 | 0.07 | Inv. |
| 203 | S1-6 | 0.15 | Inv. |
| 204 | S1-7 | 0.42 | Inv. |
| 205 | S1-10 | 0.09 | Inv. |
| 206 | S1-12 | 0.18 | Inv. |
| 207 | S1-15 | 0.34 | Inv. |

It is evident from Table 3 that the addition of a compound of the present invention can significantly prevent degradation of the raw stock stability resulting from atmospheric oxygen.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

What is claimed is:

1. A silver halide photosensitive material comprising a light-sensitive silver halide emulsion layer and a compound represented by formula (S1):

(Sl)

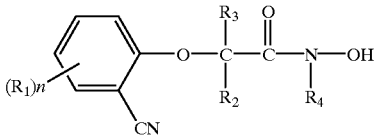

wherein $R_1$ represents a substituent group, n represents an integer from 0 to 4, $R_2$ and $R_3$ can be the same or different and represent a hydrogen atom or an alkyl group, and $R_4$ represents a hydrogen a hydrogen atom, an alkyl group, an aryl group, or a heterocyclic group.

2. The material according to claim 1, wherein $R_4$ represents a straight-chain alkyl group having the total number of carbon atoms of 1 to 6.

3. The material according to claim 1, wherein $R_4$ represents a straight-chain alkyl group having the total number of carbon atoms of 1 to 6, $R_2$ represents a straight-chain alkyl group having the total number of carbon atoms of 1 to 24, $R_3$ represents a hydrogen atom, and n represents 0 or 1.

4. The material according to claim 3, wherein $R_4$ represents a methyl group or an ethyl group, $R_2$ represents a straight-chain alkyl group having the total number of carbon atoms of 1 to 24, $R_3$ represents a hydrogen atom; and n represents 0.

5. The material according to claim 1, wherein the compound of formula (S1) is present in at least one layer selected from the group consisting of a blue-sensitive layer, a green-sensitive layer, a red-sensitive layer, a protective layer, an intermediate layer, a yellow filter layer, an antihalation layer and a magenta filter layer.

6. The material according to claim 1, wherein $R_1$ is selected from the group consisting of a halogen atom, an alkyl group, an aryl group, a heterocyclic group, a cyano group, a nitro group, a hydroxyl group, a carboxy group, a sulfo group, an alkoxy group, an aryloxy group, an acylamino group, an amino group, an alkylamino group, an anilino group, an ureido group, a sulfamoylamino group, an alkylthio group, an arylthio group, an alkoxycarbonylamino group, a sulfonamide group, a carbamoyl group, a sulfamoyl group, a sulfonyl group, an alkoxycarbonyl group, a heterocyclic oxy group, an azo group, an acyloxy group, a carbamoyloxy group, a silyl group, a silyloxy group, an aryloxycarbonylamino group, an imide group, a heterocyclic thio group, a sulfinyl group, a phosphonyl group, an aryloxycarbonyl group, and an acyl group.

7. The material according to claim 6, wherein $R_1$ is further substituted by an alkyl group, an alkenyl group, an alkinyl group, an aryl group, a hydroxyl group, a nitro group, a cyano group, a halogen atom, or a substituent group formed by oxygen, nitrogen, sulfur or carbon atoms.

8. The material according to claim 6, wherein the alkyl group is a straight-chain, branched-chain, or cyclic alkyl group having a total number of carbon atoms of 1 to 40.

9. The material according to claim 6, wherein the aryl group is an aryl group having a total number of carbon atoms of 6 to 24.

10. The material according to claim 6, wherein the heterocyclic group is a 5- or 6-membered saturated or unsaturated heterocyclic ring containing one to five carbon atoms and one or more oxygen, nitrogen, or sulfur atoms as atoms constructing this heterocyclic ring.

11. The material according to claim 6, wherein the alkoxyl group is an alkoxy group having a total number of carbon atoms of 1 to 40.

12. The material according to claim 6, wherein the aryloxy group is an aryloxy group having a total number of carbon atoms of 6 to 24.

13. The material according to claim 6, wherein the acylamino group is an acylamino group having a total number of carbon atoms of 1 to 40.

14. The material according to claim 6, wherein the alkylamino group is an alkylamino group having a total number of carbon atoms of 1 to 40.

15. The material according to claim 6, wherein the anilino group is an anilino group having a total number of carbon atoms of 6 to 24.

16. The material according to claim 6, wherein the ureido group is an ureido group having a total number of carbon atoms of 1 to 40.

17. The material according to claim 1, wherein the compound presented by formula (S1) is selected from the group consisting of (S1-1)
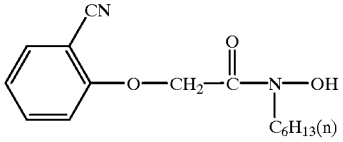
(S1-2)
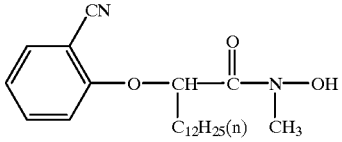
(S1-3)
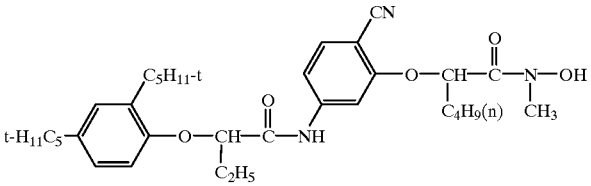
(S1-4)
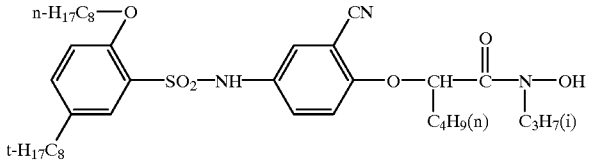
(S1-5)
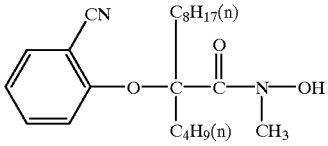
(S1-6)
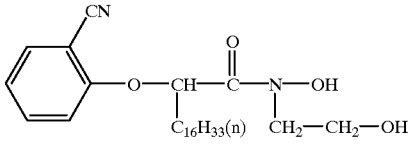
(S1-7)
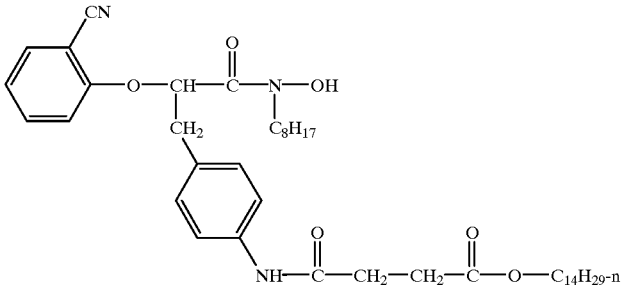
(S1-8)
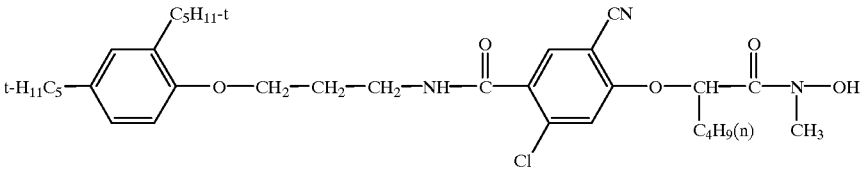
(S1-9)
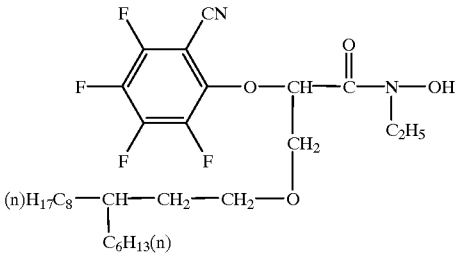
(S1-10)
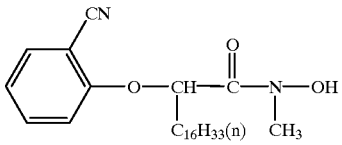
(S1-16)
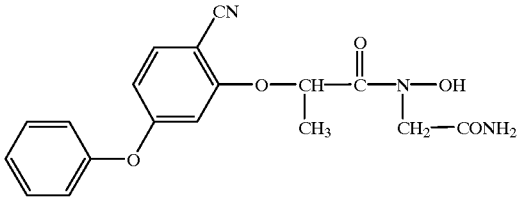
(S1-17)
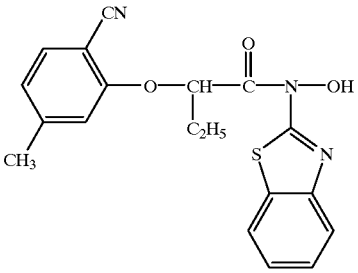

-continued (S1-18)

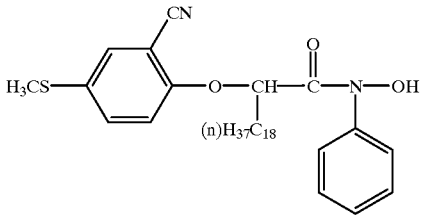

(S1-19)

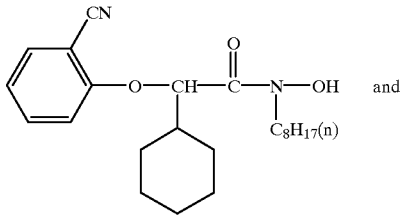

and (S1-20)

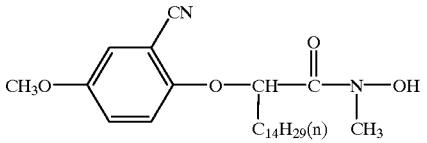

(S1-11)

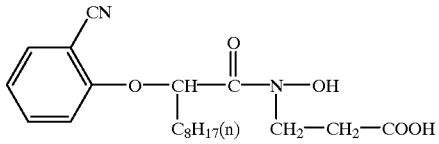

(S1-12)

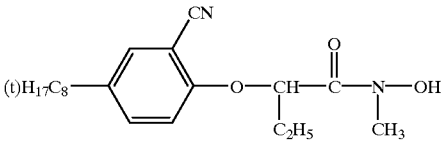

(S1-13)

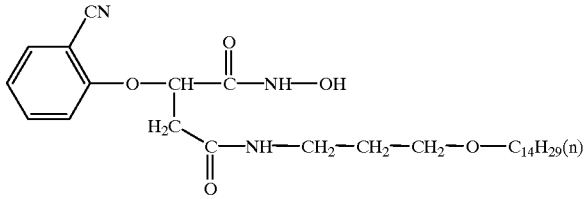

(S1-14)

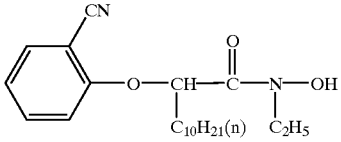

(S1-15)

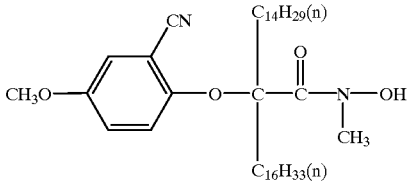

18. The material according to claim 1, wherein the compound represented by formula 1 is added to a sensitive layer and the addition amount thereof is $1\times10^{-4}$ to $5\times10^{-1}$ mol/per mol of silver halide contained in the sensitive layer.

19. The material according to claim 1, wherein the compounded is added to a non-sensitive layer and the addition amount is $10^{-7}$ to 1 mol/per mol of the total silver halide in the sensitive material.

20. The material according to claim 1, wherein the photosensitive material is a color photosensitive material comprising a support and at least one blue-, green-, or red-sensitive emulsion layer.

* * * * *